US005465786A

United States Patent [19]

Akkerman

[11] Patent Number: 5,465,786

[45] Date of Patent: Nov. 14, 1995

[54] SUBSURFACE TUBING SAFETY VALVE

[75] Inventor: Neil H. Akkerman, Houston, Tex.

[73] Assignee: Dresser Industries, Inc., Dallas, Tex.

[21] Appl. No.: 250,510

[22] Filed: May 27, 1994

[51] Int. Cl.[6] ..... E21B 34/06

[52] U.S. Cl. ..... 166/66.4; 166/66.5; 166/323

[58] Field of Search ..... 166/66.4, 66.5, 166/319, 323, 332; 251/65, 129.01, 129.19

[56] References Cited

U.S. PATENT DOCUMENTS

| | | | |
|---|---|---|---|
| 4,062,406 | 12/1977 | Akkerman et al. | 166/323 |
| 4,664,195 | 5/1987 | Deaton | 166/323 |
| 4,768,594 | 9/1988 | Akkerman | 166/319 |
| 4,852,648 | 8/1989 | Akkerman et al. | 166/66.4 |
| 4,953,616 | 9/1990 | Borden et al. | 166/66.4 |
| 5,070,944 | 12/1991 | Hopper | 166/66.4 |
| 5,176,164 | 1/1993 | Boyle | 251/129.19 X |
| 5,176,284 | 12/1992 | Leismer | 166/323 X |
| 5,343,955 | 9/1994 | Williams | 166/386 |
| 5,358,035 | 10/1994 | Grudzinski | 166/66.4 X |

*Primary Examiner*—Hoang C. Dang
*Attorney, Agent, or Firm*—Vaden, Eickenroht, Thompson & Feather

[57] ABSTRACT

There is disclosed a subsurface safety valve which is adapted to be installed in a tubing string within a well bore and of a type which remains open only so long as a controlled condition is maintained. Also disclosed are several embodiments of a mechanism for holding a rotary control rod of such a valve or other apparatus in a desired rotational position to maintain it open, or otherwise in a desired state, and then releasing it, upon loss of the controlled condition, for return to its original rotational position.

10 Claims, 23 Drawing Sheets

107
108
105
104
23
41
27
32
90
60
10
10
40
11
11

80
81
14
14
78
76
82
27
75
66
88
83
70
71
26

23
20
65
12
12
40
21
61
30
28
13
13
42

65
67
68
54A
55D
55A
53B
53A 46
36
35
45
37
50
26
25

56A
26

105
104
41
66
90
32
10
10
60
40
66A
11
11
23

103
80
15
15
76
78
82
77
27
87
88
86
90
66
85
70
71
86

40
20
12
12
61
21
30
28
13
13
42

67
65
68
60A
54A
56A
53A
53B 107
108
105
104
23
27
41
32
40

80
81
78
76
82
27
75
66
83
70
26
71

FIG. 12
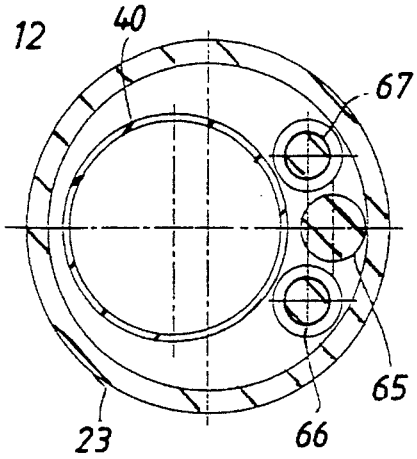
FIG. 9
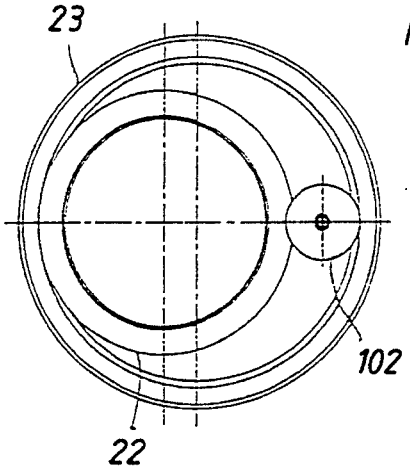
FIG. 13
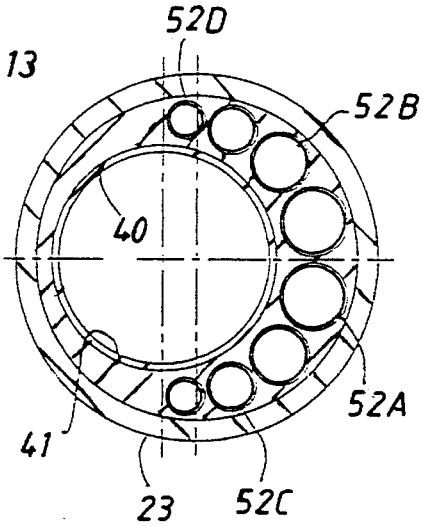
FIG. 10
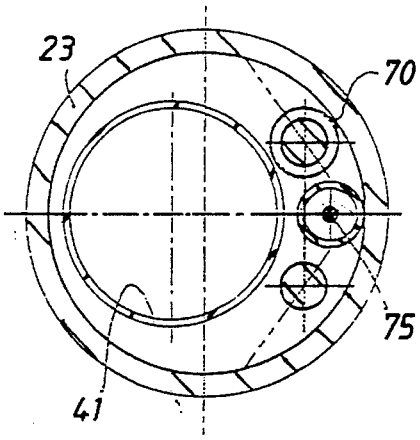
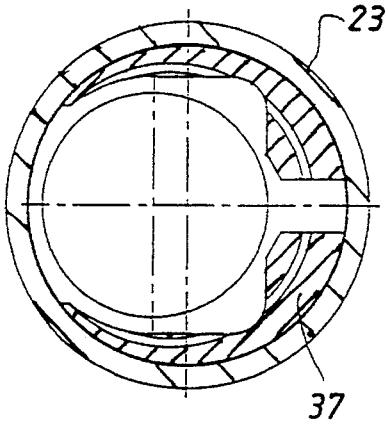
FIG. 13A
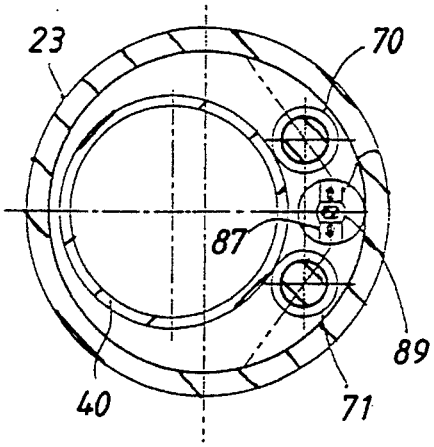
FIG. 11

SUBSURFACE TUBING SAFETY VALVE

This invention relates generally to a subsurface safety valve adapted to be installed in a tubing string within a well bore of a type in which the valve is held open only so long as a controlled condition is maintained. More particularly, in one of its aspects, it relates to improvements in valves of this type in which the valve is moved from closed to open and from opened to closed positions by means of energy which is stored in springs in response to variations in pressure across the closure member of the valve in its closed position. In another of its aspects, the invention relates to improvements in a mechanism for a rotary control rod of the valve or other apparatus which is held in a rotative position to which it has been moved as long as the controlled condition is maintained and then released to permit it to be yieldably urged back to its original position when the condition is lost.

Thus, for example, as shown and described in U.S. Pat. No. 4,768,594, assigned to the assignee of the present application, energy is stored in both an opening coil spring and a closing coil spring in response to pressure differentials due to one or both of an increase in well pressure holding the valve member closed or bleeding off of pressure above the closed valve member. One embodiment of the valve has an arrangement for holding energy generated in the closing spring, as the valve member is moved to open position by the opening spring, upon a decrease in the differential across valve member. The valve remains open as long as the controlled condition is maintained to transmit a signal from the wellhead or other remote location to a control mechanism. When the signal is lost due to failure of the controlled condition, the signal is deactivated to release the energy of the closing spring to move the valve member to closed position. Then the valve may be reopened and rearmed by restoration of the pressure differential and reactivation of the signal.

More particularly, the control mechanism includes an electromagnetic device which is activated by a radio signal transmitted through the earth's surface, which is of particular advantage over conventional safety valves, particularly at substantial depths, which are held upon by a column of control fluid from a source at the surface. Also, the central mechanism includes a unique arrangement including a rotary control rod which is moved to a position to hold the valve open by the stored energy, and held in that position, against forces urging it to its original rotational position, by only a very small amount of power.

However, the valve is not "full opening" inasmuch as the valve member merely reciprocates in the flowway between opened and closed positions. Furthermore, although another form of the valve shown in such patent is full opening in that its closure member is a flapper which is spring pressed to closed position, the means by which it is operated is hydraulically actuated and of relatively complex construction, relying upon its energy from an accumulator. Still further, the control mechanism of the prior valve includes a signal responsive solenoid detent which, if prematurely activated, prevents the valve from being moved to a ready position.

In addition, the outer dimension of this latter form of the prior valve, is necessarily large to accommodate annulus pressure chambers about the flowway. Thus, as compared with other valves wherein the control mechanism is disposed above the space to one side of the valve seat in which the flapper is received when open, it is necessary to either reduce the size of the flowway or the size of the well bore in which the valve may be used.

The primary object of the present invention is to provide a subsurface safety valve having the advantages, without the disadvantages, of the aforementioned valves.

Another object is to provide such a valve which is full opening and in which spring energy may be stored and released without the need for complex hydraulic systems, but instead with simple and compact mechanical arrangement.

A more particular object is to provide such a valve which is of minimum lateral dimension for a flowway of given size.

Still another object is to provide a control mechanism for such a valve or other apparatus which may be activated at any time without risk of damage to its parts.

These and other objects are accomplished, in accordance with the novel aspects of the invention, by a subsurface tubing safety valve which comprises an elongate housing connectable as part of a tubing string disposable within a well bore and having a flowway therethrough, upper and lower guide bodies received in the housing each having bores therethrough aligned with the flowway, and a flapper pivotally mounted on the housing for swinging between a first position to open the flowway and yieldably urged closed. Each of a lower plate above the lower guide body and an upper plate below the upper guide body has a bore therethrough aligned with the bore of the upper guide body, and a flow tube is secured to the upper plate and extends through the bores in the lower plate and lower guide body for reciprocating therein so that, when lowered, its lower end moves the closed flapper to open position. A piston means is sealably reciprocable within the lower guide body so as to be urged upwardly in response to well pressure beneath it, first, second and third rods extend upwardly from the lower plate through the upper plate and into the upper guide body, and an opening coil spring disposed about the second rod extends through the upper plate to engage at opposite ends with the lower plate and upper guide body and a closing coil spring disposed about the third rod engages at opposite ends with the upper and lower plates.

A control rod extends within the second rod for rotation with respect to it, a means on the upper guide body and control rod yieldably urges the control rod in one direction to a first limited rotational direction, and a means on the control rod and second rod rotate the control rod in the other direction to a second limited position upon raising of the second rod as the pistons are raised in response to an increase in differential across the closed flapper. More particularly, a means is operable, upon rotation of the control rod to its other position, and lowering of the pressure differential, to prevent downward movement of the second rod with respect to the upper plate and thus to store energy in both springs as they are compressed by raising of the lower plate, and a control mechanism mounted on the housing includes means activated in response to a signal representing a controlled condition so as to prevent rotation of the control rod in the opposite direction, whereby, as long as said means is activated, the pressure differential may be reduced to permit the opening spring to lower the lower plate and pistons and thus the flow tube to open the flapper, the deactivation of the signal releasing the second rod from the upper plate to permit the closing spring to raise the flow tube and thus permit the flapper to close.

In the preferred and illustrated embodiment of the invention, the valve housing also includes a laterally enlarged cylindrical portion on one side of the flowway intermediate its ends whose axis is eccentric to the flowway to provide a space between them, with the upper and lower guide bodies being received in the enlarged portion of the housing and each having bores therethrough aligned with the flowway.

The flapper is pivotally mounted on the housing for swinging between a first position engaged with a seat about the bore of the lower body to close the flowway and a second position within a recess in the housing beneath the space to open the flowway. The lower guide body has additional bores therethrough connecting the space with the lower end of the housing outside of the seat, and a plurality of pistons are sealably reciprocable in the additional bores so as to be urged upwardly in response to well pressure beneath them. More particularly, the upper body has additional bores therethrough, and the first, second and third rods extend upwardly from the lower plate and through the upper plate within the space and into the additional bores of the upper guide body, and the control mechanism is mounted on the housing to one side of the upper portion thereof and above the space, thus enabling the overall valve to be of minimum cross-sectional area for a given size of flowway.

In accordance with another novel aspect of this invention, the mechanism for releasably holding the control rod of the above-described valve or other apparatus, includes a part rotatable with the control rod and mounted in another housing or body mounted on the housing of the valve, a control body surrounding and movable axially with respect to said part, and a wrap spring having one portion disposed closely about a cylindrical surface on said part and another portion loosely disposed about an aligned cylindrical surface fixed to the valve housing and held at the end of its other portion, whereby said control rod is free to rotate in said one direction but is held against rotation in the other direction. A ratchet wheel is mounted on the control body and has teeth with abrupt and inclined surfaces, a pin is mounted in the control body for reciprocation between positions in which one end is engaged and disengaged with the ratchet teeth, and a means is responsive to activation of a signal indicative of the failure of the controlled condition to force the one end of the pin against the ratchet teeth and thereby restrain the ratchet wheel from rotation in said other direction.

More particularly, the inclined surfaces of the ratchet wheel teeth are free to move past the end of the pin to permit the control body and thus the control rod to rotate in said other direction, and a means is disposed between the ratchet wheel and control body to frictionally engage the ratchet wheel for rotation with the body in said one direction but permit rotation of the control body with respect thereto in the opposite direction. Preferably, and as illustrated, the mechanism further includes a dog mounted on the control body of the control mechanism in position to move into and out of engagement with the ratchet teeth, and means yieldably urging the dog into engagement with the ratchet teeth so that it will engage an abrupt surface thereof and thus locate the ratchet wheel in a desired position to be engaged by the end of the pin.

DESCRIPTION OF PREFERRED EMBODIMENT

In the drawings, wherein like reference of characters are used throughout to designate like parts:

FIGS. 1A, 1B, 1C and 1D are longitudinal sectional views, partly in elevation, of the upper, upper intermediate, lower intermediate and lower portions of a subsurface safety valve constructed in accordance with the present invention, and wherein the pistons for storing energy in the springs are in their lowered positions and the opening and closing springs in a relatively relaxed state, as would occur when the pressure in the valve above the flapper is not substantially less than well pressure below the flapper;

FIGS. 2A, 2B, 2C and 2D are views similar to FIGS. 1A, 1B, 1C and 1D, respectively, but as seen from the right and along a plane essentially perpendicular to those of FIGS. 1A to 1D;

FIGS. 3A, 3B, 3C and 3D are longitudinal sectional views, partly in elevation, of the upper, upper intermediate, lower intermediate and lower portions of the valve similar to those of FIGS. 1A–1D and 2A–2D, respectively, but with the pistons raised to compress the opening and closing springs and thus store energy therein in response to a predetermined increase in the differential pressure upwardly across the closed flapper, and with the rotary control rod rotated to a position to move keys carried thereby into position for engaging an upwardly facing seat on the upper plate carried by the flow tube, and thus with the torsion spring rotated from the position shown in FIG. 14 to that shown in FIG. 15, whereby the rod may be held in its rotated position by the control mechanism in response to a signal representing a controlled position;

FIGS. 4A, 4B, 4C and 4D are views similar to FIGS. 3A, 3B, 3C and 3D, respectively, but seen from the right, as in FIGS. 2A to 2D.

FIGS. 5A, 5B, 5C and 5D are longitudinal sectional views, partly in elevation of the upper, upper intermediate, lower intermediate and lower portions of the valve, respectively, similar to those of FIGS. 3A to 3D, but showing the flow tube lowered against the upper side of the flapper and the keys lowered to seat upon the upper plate connected to the flow tube, and with the control mechanism at the upper end of the valve holding the rotary control rod to prevent its retrograde rotation, in response to a signal representing the controlled position so as to maintain the keys in position;

FIGS. 6A, 6B, 6C and 6D are views similar to FIGS. 5A, 5B, 5C and 5D, but viewed from the right as in FIGS. 2A to 2D.

FIGS. 7A, 7B, 7C and 7D are longitudinal sectional views, partly in elevation, of the upper, upper intermediate, lower intermediate and lower portions of the valve, with the valve moved to its open position in response to a further increase in the pressure across the flapper so as to move the flapper to open position and release the opening spring, and the pistons moved downwardly in response to opening of the flapper, the valve thus being in a position from which it may close automatically in response to the loss of the signal due to the discontinuance of the maintained condition;

FIG. 9 is a view of the upper end of the valve as seen along broken lines 9—9 of FIG. 1A;

FIGS. 10, 11, 12, 13 and 13A are cross-sectional views of the valve as seen along broken lines 10—10 and 11—11 of FIG. 1B, 12—12 of FIG. 1C, 13—13 of FIG. 1C, and 13A—13A of FIG. 1D.

Figure 16A:
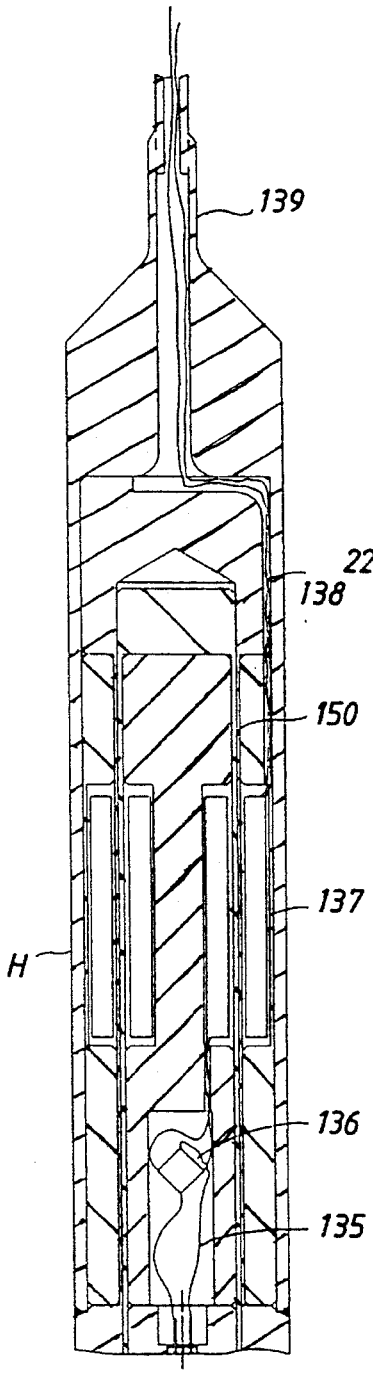
FIGS. 16A and 16B are enlarged longitudinal sectional views, partly in elevation, of the upper and lower ends of the control mechanism of the above described valve, and with the pin thereof in its deactivated position prior to receipt of a signal in response to a controlled condition.
Figure 18A:
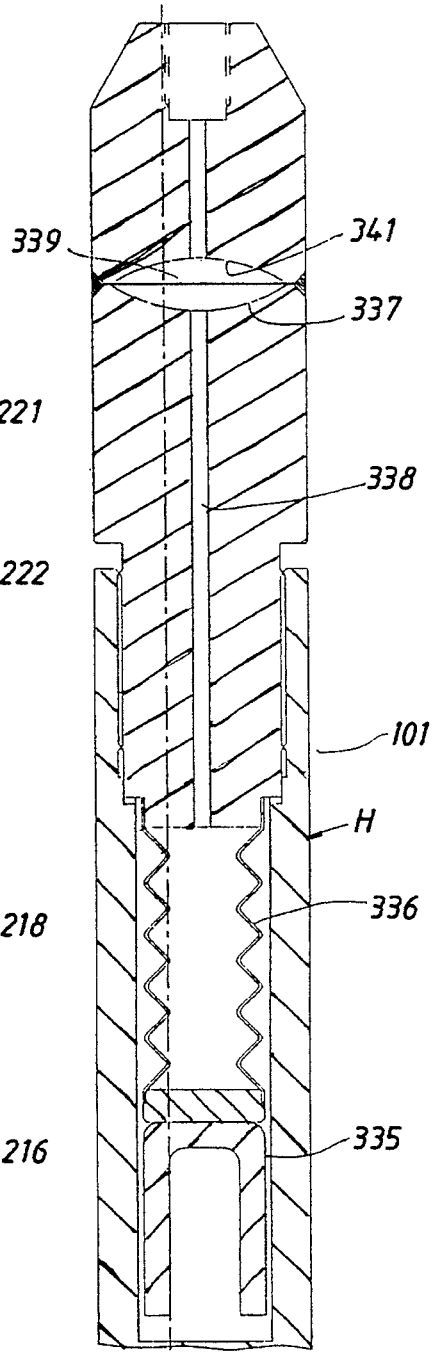
Figure 18B:
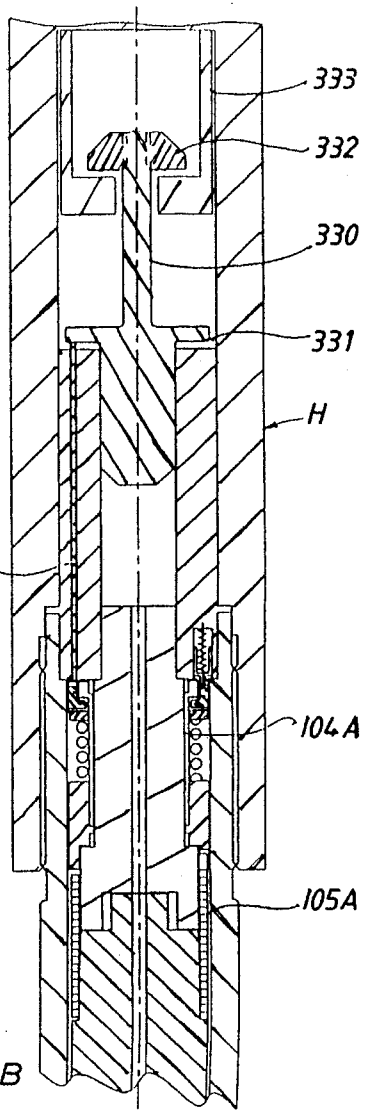
Figure 16B:
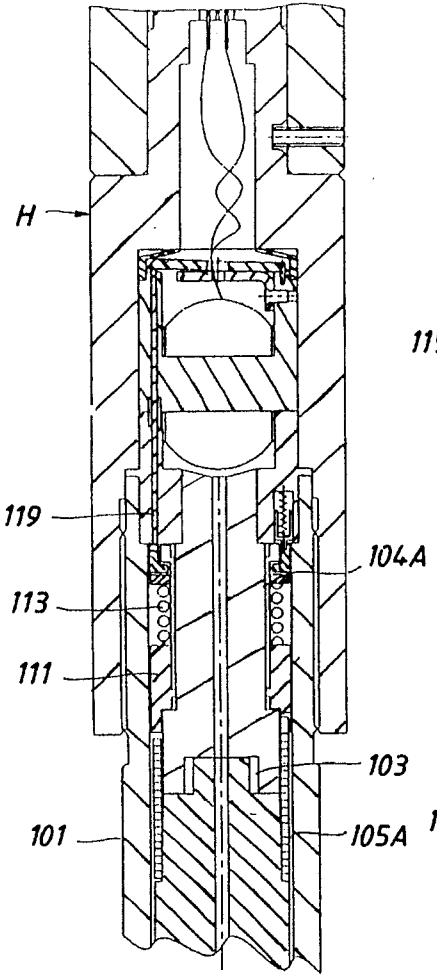
Figure 20:
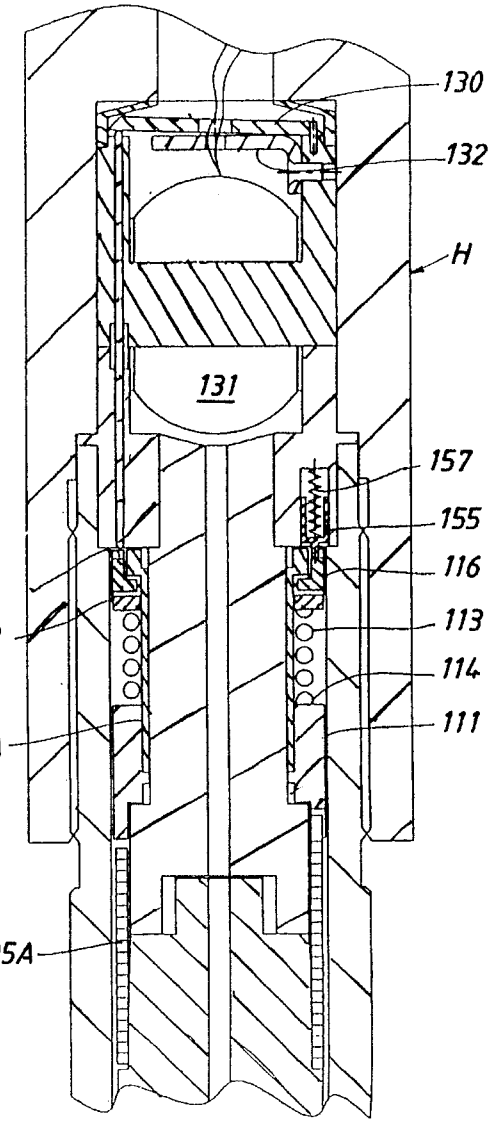
Figure 19:
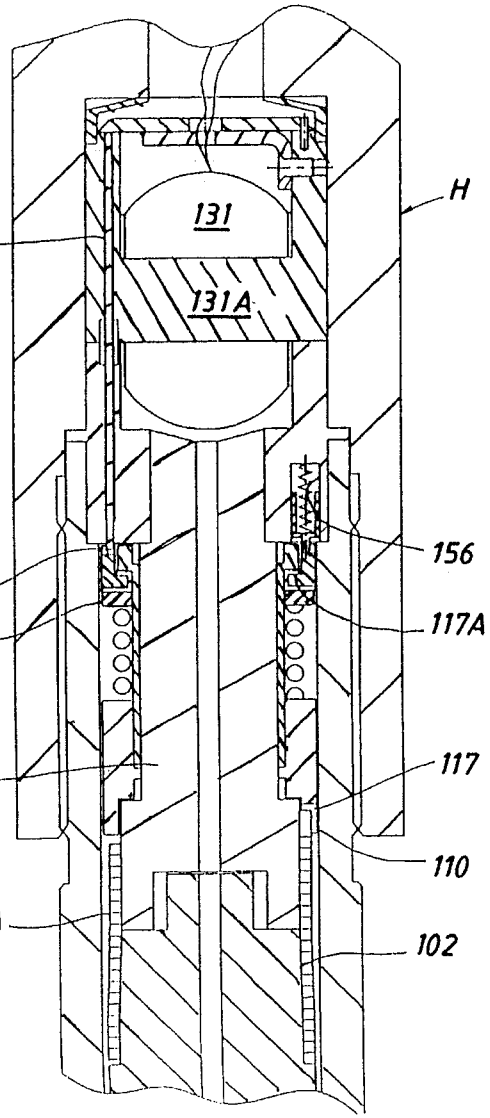
Figure 21:
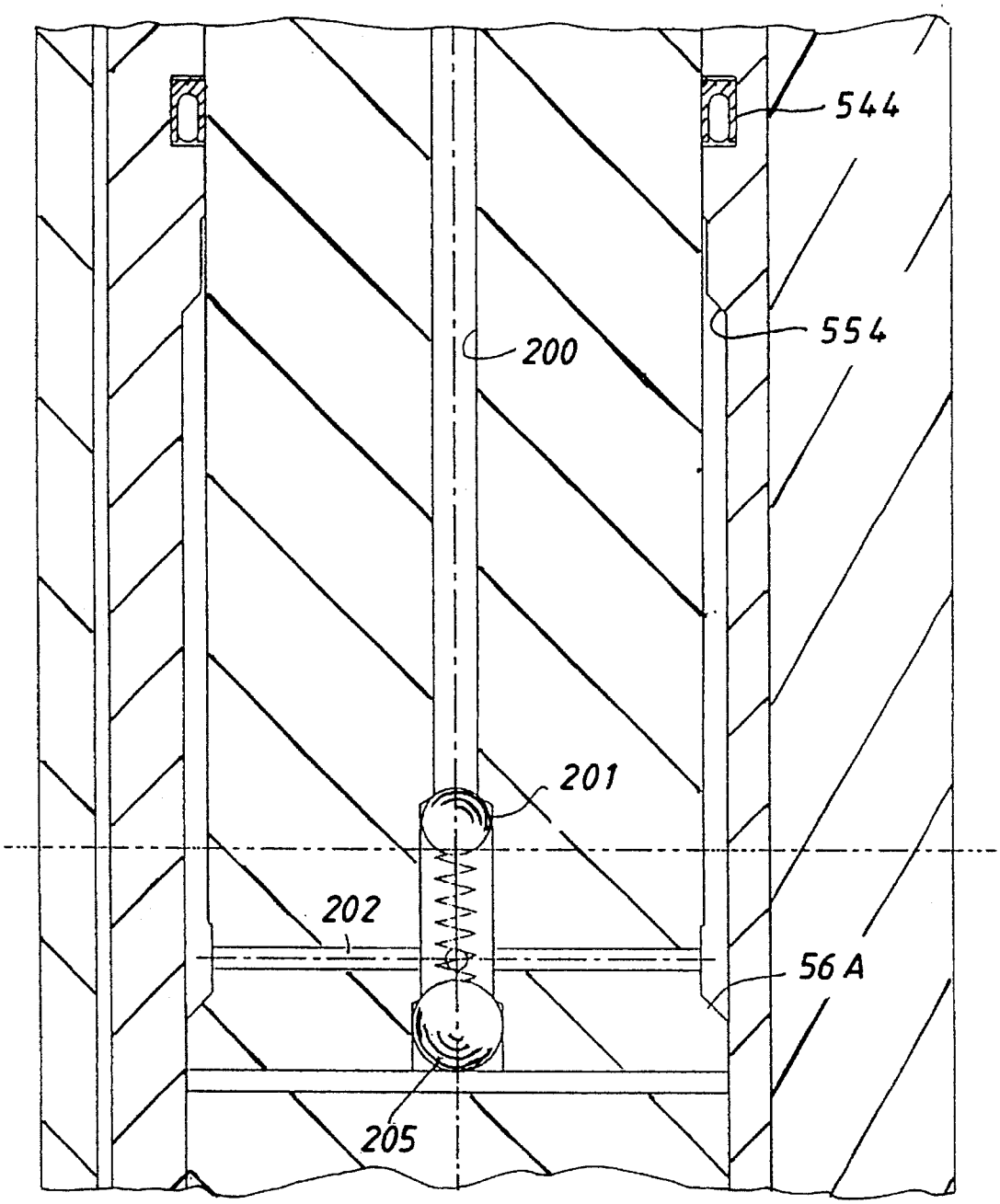
Figure 22A:
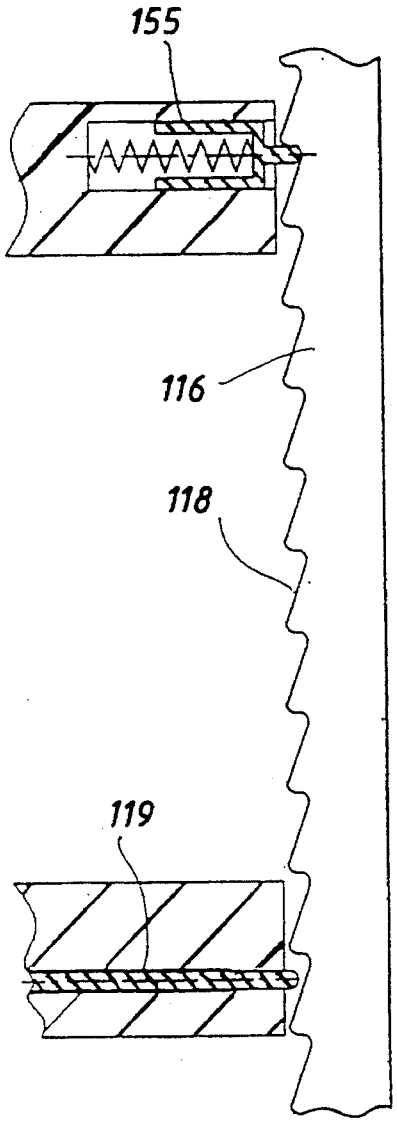
Figure 22B:
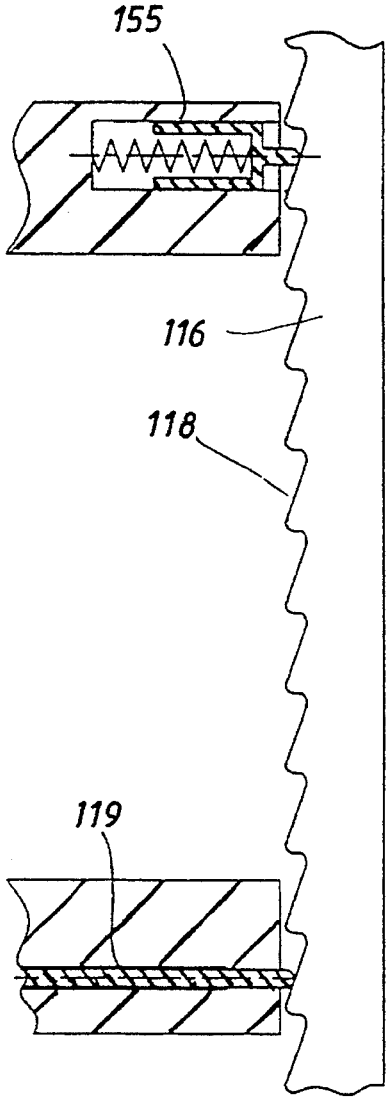

FIGS. 18A and 18B views are also similar of still another alternative form of the control mechanism;

FIG. 19 is an enlarged longitudinal sectional view of the lower portion of the control mechanism of FIGS. 16A and 16B, prior to activation of the pin;

FIG. 20 is a view similar to FIG. 19, but upon activation of the pin in order to hold the rotary control rod against return movement to its original position, thus enabling the valve to be opened;

FIG. 21 is an enlarged cross sectional view of the lower end of one of the pistons; and FIGS. 22A and 22B are developed views of the pin and ratchet wheel in their relative positions upon location of the teeth on the wheel to receive the pin and retrograde rotation of the wheel due to the torsion spring.

With reference now to the details of the above-described drawings, the overall tool, which is indicated in its entirety by reference character 20, includes an elongate housing 21 adapted to be connected at its upper and lower ends as part of a tubing string suspended in a well bore. The housing includes, from top to bottom, an upper tubular member 22 connected at its upper end to the lower end of the upper section of the tubing string, an intermediate tubular member 23 connected to member 22 by a nut 24, and a lower tubular member 25 connected at its lower end to the upper end of the lower tubing section and connected by a nut 26 at its upper end to the lower end of the intermediate tubular member. As will be described to follow, the housing has a flowway therethrough to form a continuation of the upper and lower tubing sections and a diametrically enlarged portion intermediate its ends arranged eccentrically of the flowway.

An upper guide body 27 is disposed closely within the upper end of the enlarged intermediate tubular member 23 just beneath the lower end of the upper tubular member 22, and a lower guide body 28 is disposed closely within the enlarged intermediate tubular member 23 toward its lower end but above the lower tubular member 25. The lower guide body is held in a fixed vertical position between a flapper cage 37 below it and a downwardly facing shoulder 30 on the inner diameter of the intermediate member. The upper guide body 27 is held in a fixed vertical position within the housing between the lower end of the upper tubular member 22 and a snap ring 32 held in the enlarged inner diameter of the intermediate tubular member. Each of the upper and lower guide bodies is provided with bores 41 and 42 therethrough aligned with bores through the upper and lower tubular members 22 and 23.

A flapper 35 is pivotally mounted within the housing by means of a pin 36 mounted on the cage 37 below the offset space for swinging between a closed position in which its upper face engages a seat on a downward tubular extension of the lower guide body 28, and an open position to one side of the seat within a recess in the cage and beneath offset space in the enlarged portion of the lower guide body 28. A flow tube 40 is vertically slidable within bore 41 through the upper guide body and bore 42 through the lower guide body. As shown, when the flapper is closed, the lower end of the flow tube is either spaced just above the flapper, as shown in FIGS. 1D, 2D, 3D and 4D, or with its lower end engaged therewith, as shown in FIG. 5A, 5B, 5C or 5D.

The flapper is urged closed by a torsion spring 45 anchored at one end by a pin 46 on the cage and bearing at its other end on the lower side of the flapper. As will be described to follow, and as shown in FIGS. *7d* and *8d*, the flow tube is adapted to be lowered so as to overcome the torsion of the spring 45 and other forces tending to maintain the flapper closed, so that the flapper moves into the cage recess and the lower end of the flow tube moves downwardly onto a seat 50 on the lower portion of the cage. In this position, the lower end of the flow tube forms a continuation of the bores through the lower guide body and lower tubular member.

Figure 3C:
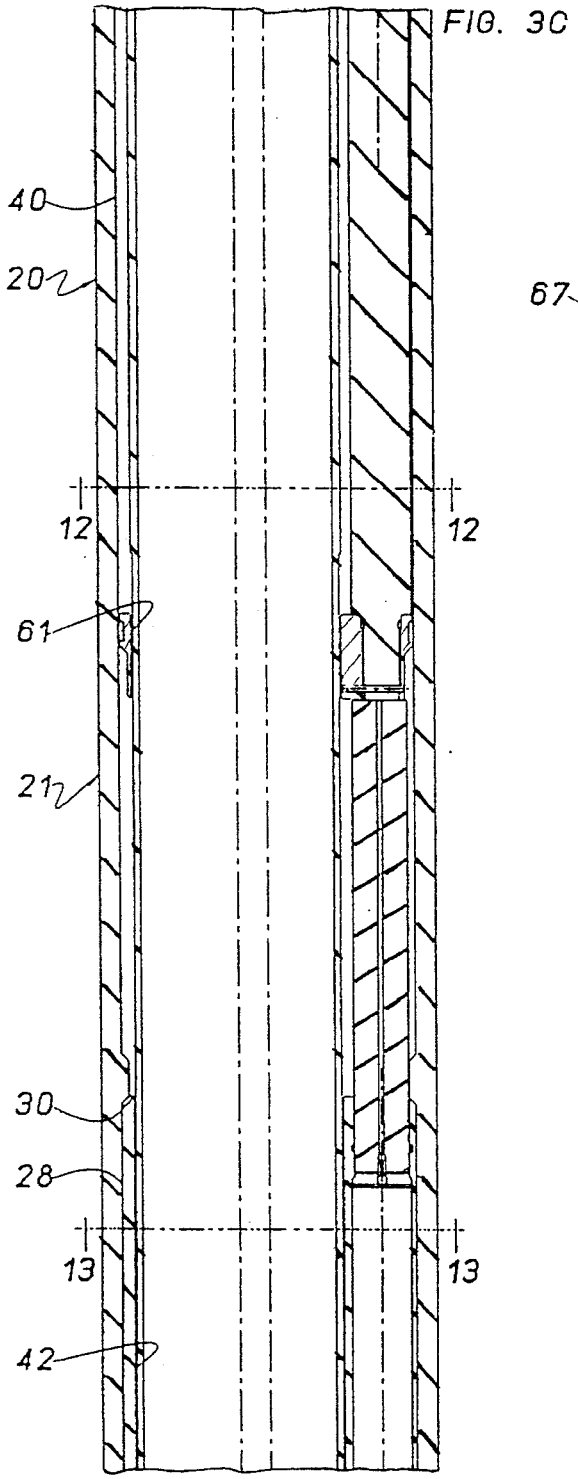

The lower guide member is formed with additional smaller vertical bores in the laterally offset portion thereof parallel to the bore which receives the flow tube in the flowway through the housing. Thus, as best shown in FIG. 13, these include larger bores 52A in the widest portion of the guide member, somewhat smaller bores 52B formed adjacent the bores 52A, and still smaller holes 52C and 52D in the relatively thin end portions of the guide body. As previously described, pistons 53A, 53B, 53C and 53D are received within the bores 52A, 52B, 52C and 52D, respectively for reciprocation within seal rings 54A–54D received within grooves about the bores toward the upper ends thereof. There is a seat (55A for example) facing downwardly in each bore beneath the seat ring therein in position to engage a shoulder 56A (for example) about the lower end of each piston to limit its upward movement and form a metal to metal seal therewith beneath the seal rings (see FIGS. 3C and 4C).

As shown in FIGS. 1A to 1D and 2A to 2D, in their lower most positions, the lower ends of the pistons are seated on the top of the flapper cage with their upper ends extending slightly above the upper end of the lower guide body. This in turn locates the lower end of the lower guide body above the flapper cage and a downwardly facing shoulder thereabout above a seat about the inner diameter of the enlarged diameter portion of tubular member 23. With the flapper closed, well pressure in the well bore beneath the flapper will have access to the lower ends of the pistons to urge them upwardly. For this purpose, and as best shown in FIG. 13A, arcuate grooves are formed on the upper surface of the eccentric portion of the cage to connect at their ends with open areas of the upper end of the cage. Also, a groove 46 is formed laterally across the lower end of each piston to connect with the arcuate groove.

An upper plate 60 is carried within a groove about the flow tube for disposal beneath the upper guide body when the flow tube is in its uppermost position with its lower end above the flapper (see FIGS. 1A–1D, 2A–2D, 3A–3D and 4A–4D). As shown in FIGS. 5A–5D and 6A–6B, upon initial downward movement of the flow tube to engage the flapper, its upper end is spaced a short distance below the upper guide body. Then, as the flow tube is moved downwardly to open the flapper, as shown in FIGS. 7A to 7D and 8A to 8D, the upper plate moves downwardly with it a relatively substantial distance below the lower end of the upper guide body.

A lower plate 60A is disposed above the upper end of the lower guide body for reciprocation vertically within the enlarged tubular member 23 and has bore 61A which closely surrounds the flow tube as well as bores in the laterally offset portion to receive first rod 65, second rod 67 and third rod 68. Each rod is threadedly connected at its lower end to the lower plate for movement vertically therewith and has an upper end which is received within a bore in the upper guide body 27.

An opening coil spring 70 surrounds the rod second 67 and is disposed between lower plate 60A and the lower side of the upper guide body surrounding the bore in the upper plate in which the upper end of the rod is received. A closing spring 71 surrounds the third rod 68 and is disposed between the upper and lower plates. Both springs are slightly pre-compressed but relatively relaxed state in the position of the valve shown in FIGS. 1A and 1D and 2A and 2D.

A rotary control rod 75 extends within the open upper end of the bore for first rod 65 and through the upper hollow end 66A of the rod 65 itself into a lower reduced bore 66B therebelow. An enlarged upper end 76 of rotary control rod 75 has a slot 77 formed therein to receive a pin 78 extending inwardly into the upper end of the bore which receives rod 65 so as to support the rotary control rod within the upper guide body 27 with its upper end adjacent the upper end of the body. The slot permits the control rod 75 to rotate in a clockwise direction (looking down) from a position in which its one end is adjacent the inner end of the pin 78 to a position in which its other end stops the clockwise movement of the control rod by engagement therewith the pin 78 (see FIGS. 14 and 15).

Figure 15:
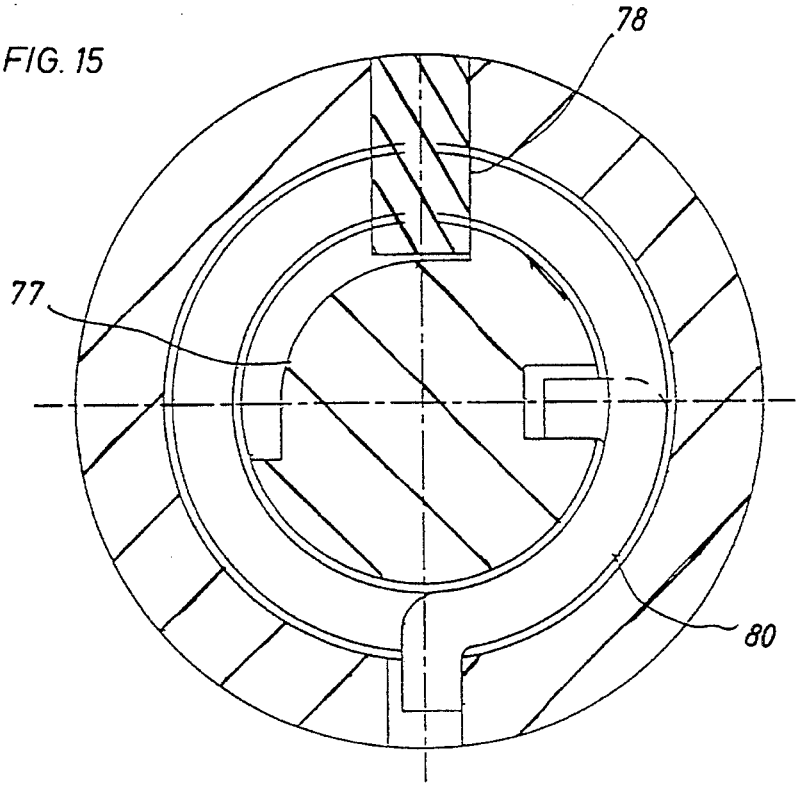
FIG. 15 is a view similar to FIG. 14, but with the torsion spring in its tightened valve in the position of FIGS. 3A to 3D, and 4A to 4D, and as seen along broken lines 15—15 of FIG. 4B.
Figure 14:
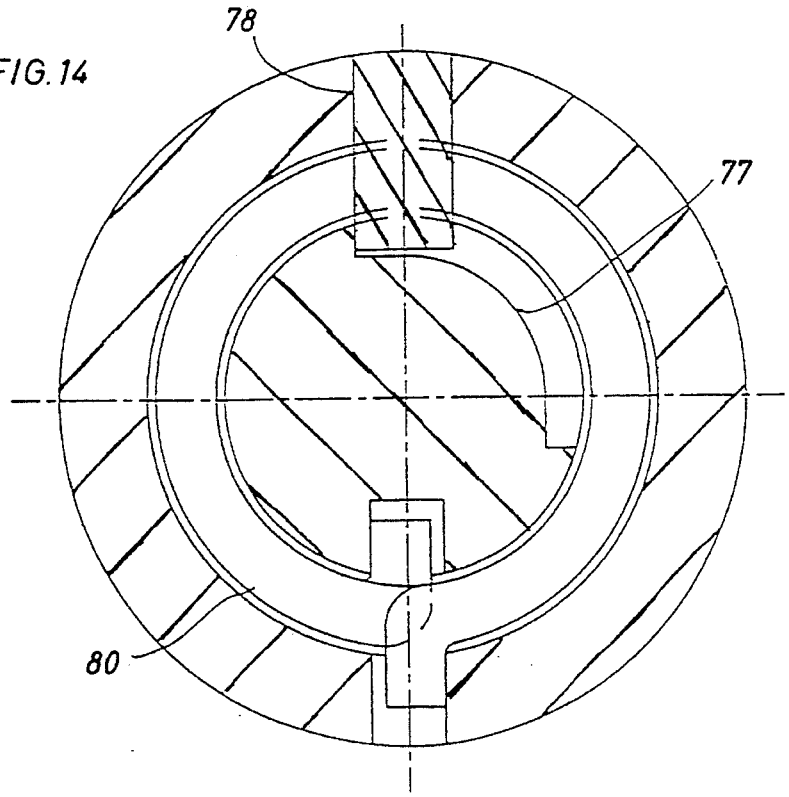
FIG. 14 is an enlarged cross-sectional view of the valve in the position of FIGS. 1A to 1D and 2A to 2D, and as seen along broken lines 14—14 of FIG. 2B, showing the torsion spring in a relatively relaxed state.

As best shown in FIGS. 14 and 15, a torsion spring 80 is wound about the enlarged upper end 76 of the control rod with one end anchored thereto and the other end anchored in a hole 81 in the bore of the upper guide body 27. In this position, the torsion spring exerts a slight force on the control rod to maintain it in the position shown in FIG. 14. However, as the control rod rotates in a clockwise direction to the position of FIG. 15, the torsion spring 80 is wound tighter so as to increase the force tending to return the control rod to its original position.

A pin 82 extends through the lower end of the enlarged upper portion 76 of the rotary control rod 75 to dispose its opposite ends in position to be engaged by cam surface 83 on the upper end of the hollow upper portion of the control rod 65 as it moves upwardly to compress the opening and closing springs, as shown in FIGS. 3A–3D and 4A–4D. This movement of the cam surface along the pins 82 will turn the control rod 75 in a clockwise direction and thus wind the torsion spring tighter, as shown in FIGS. 14 and 15, tending to urge it in the opposite rotational direction.

The central rod 65 has an elongate opening 85 therein extending axially downwardly from the lower end of the bore to connect with fluid pressure on the upper ends of the pistons below the lower guide body. The upper end of elongate opening 85 is enlarged to provide a cylindrical bore to receive a rotary cam member 86 (FIG. 11) which is held therein by a snap ring. More particularly, the cam member has flat sides disposed between the inner ends of keys 88 which are slidably received in lateral slots 89 and retained by pins within slots to permit them to be moved outwardly by the cam member from the inner position of FIG. 2B beyond the outer diameter of the central rod when the cam is rotated to the position shown in FIG. 4B. This, of course, occurs, before the rotary control rod is rotated by means of cam member 83 as the lower plate 60 is raised to energize the opening and closing springs. The outer edges of the pins are tapered to facilitate their being urged inwardly as they move through the upper plate.

Figure 1A:
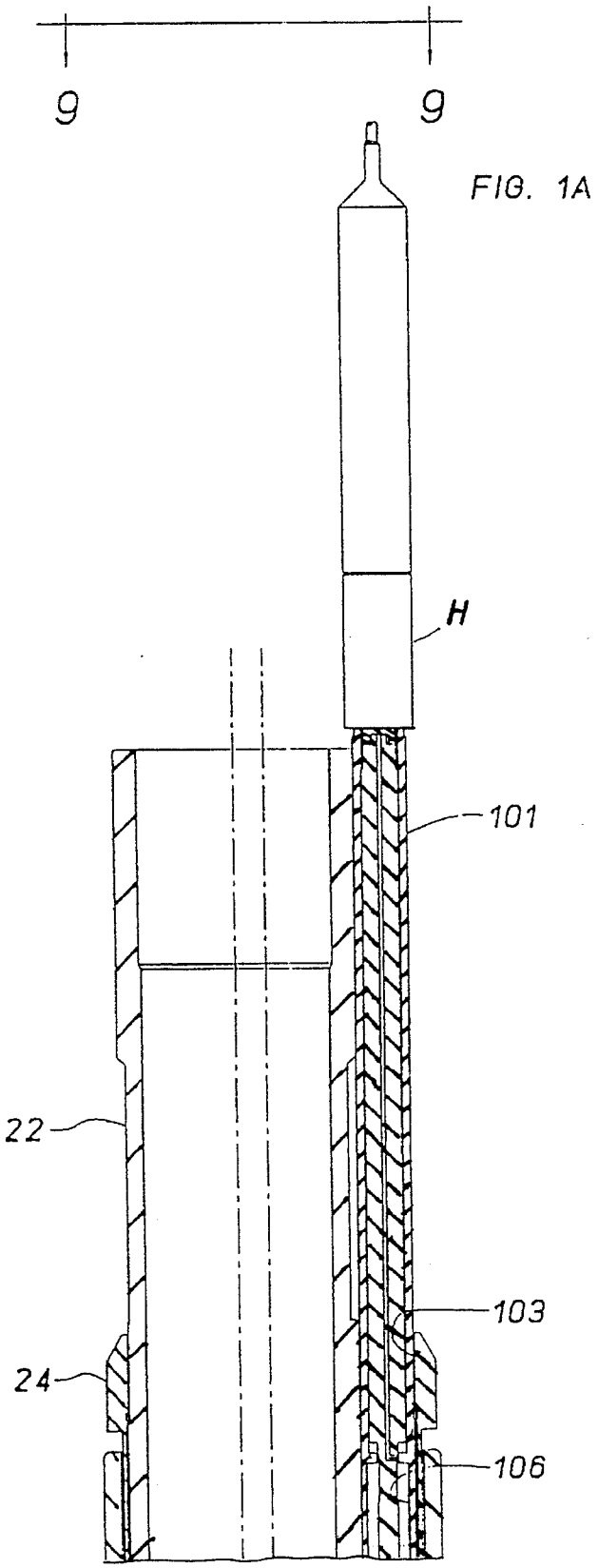
Figure 2A:
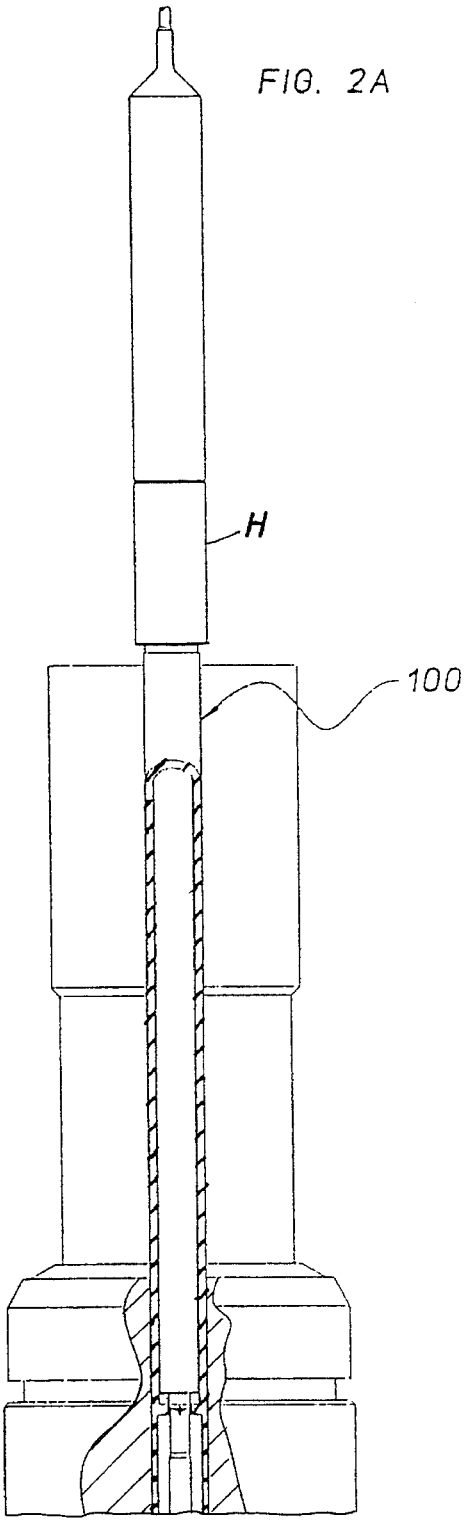
Figure 1B:
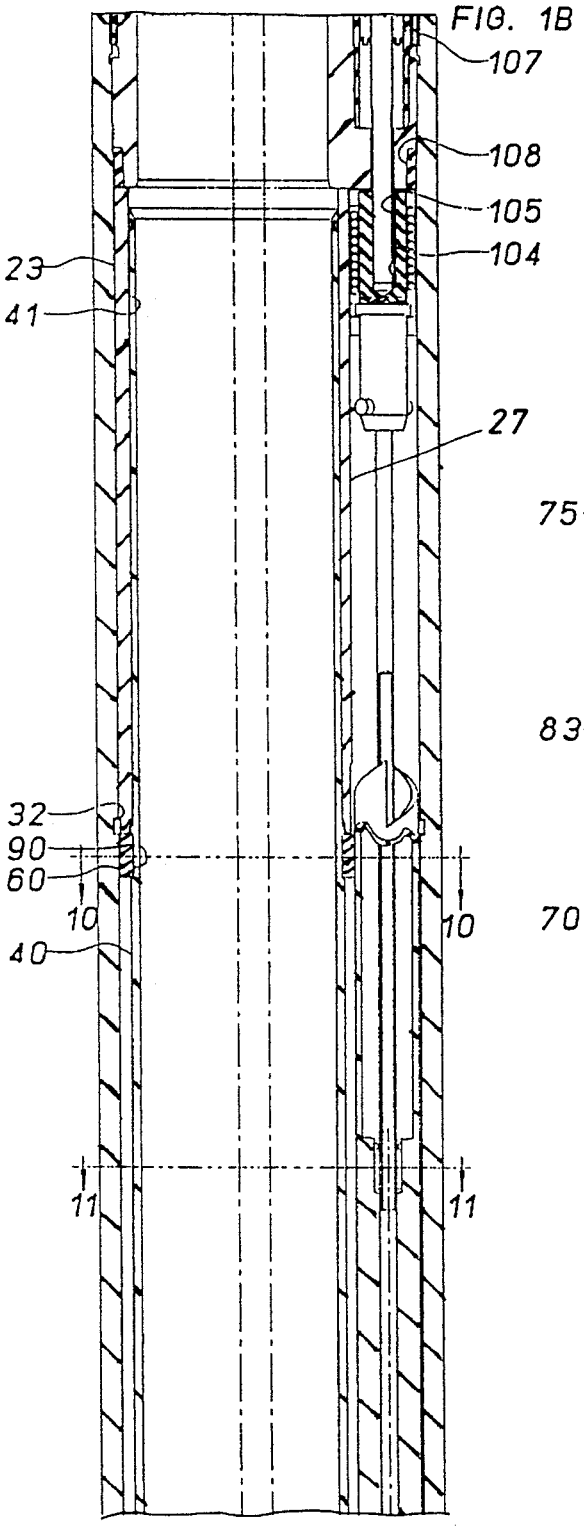
Figure 2B:
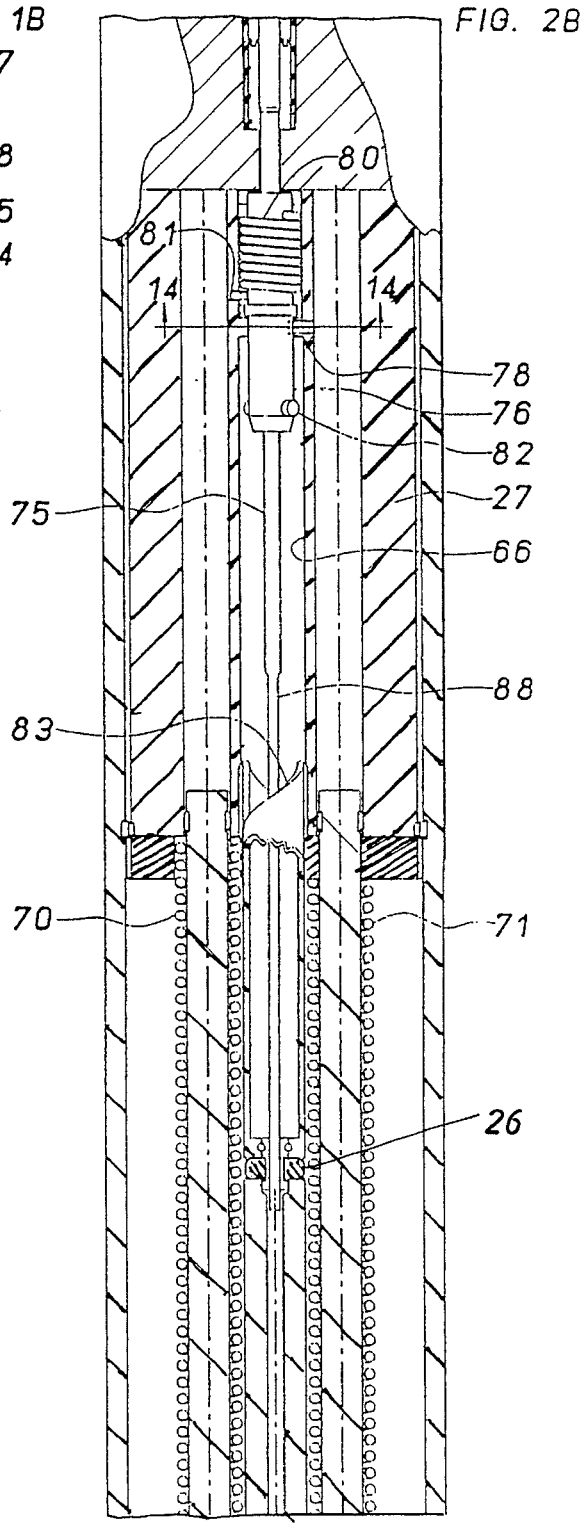
Figure 1C:
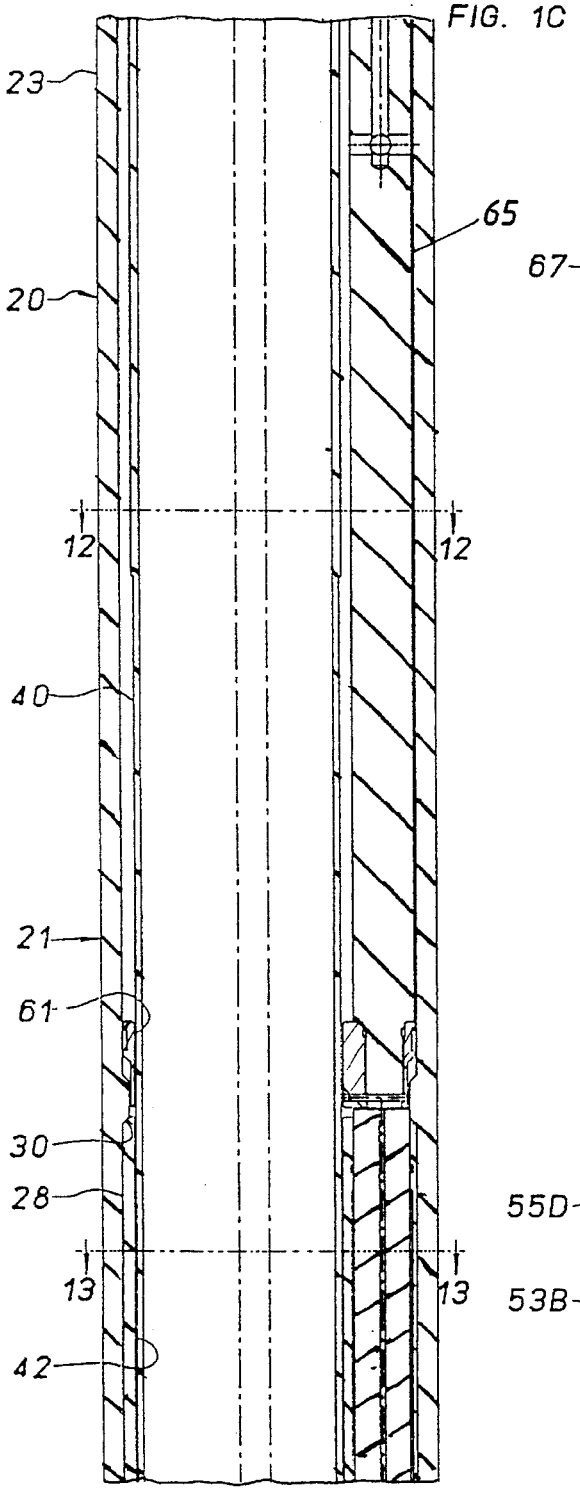
Figure 2C:
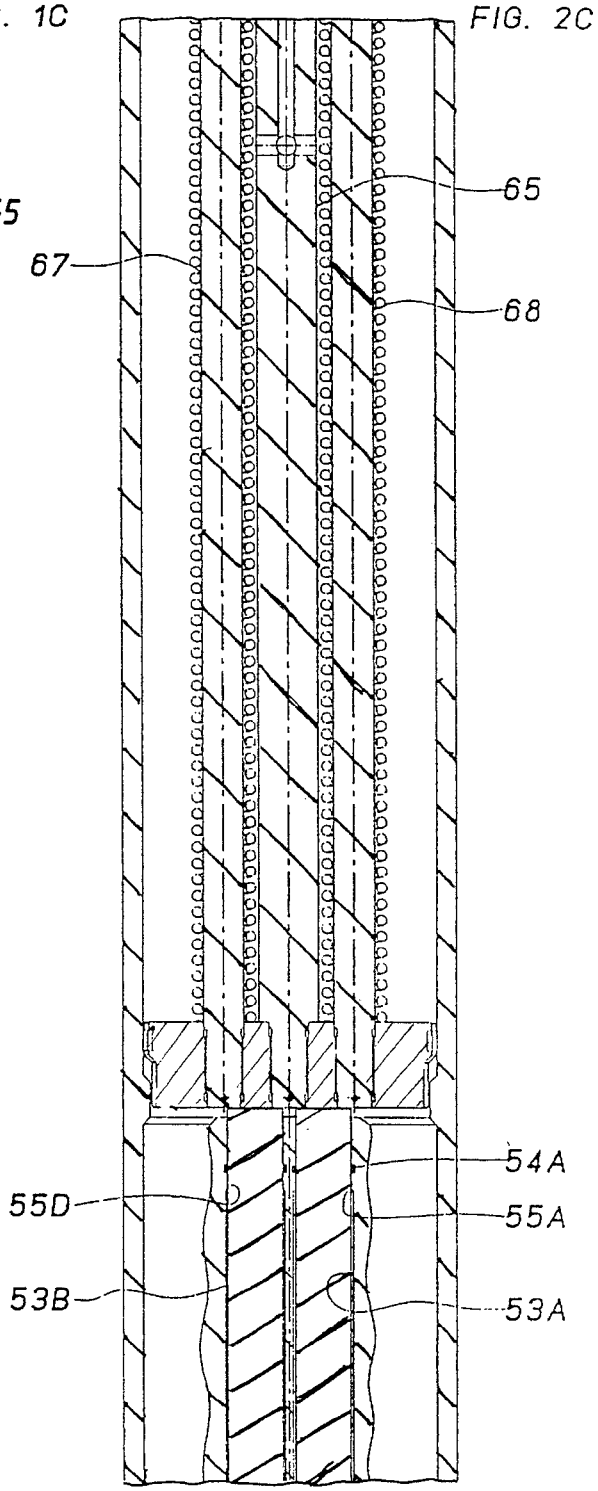
Figure 1D:
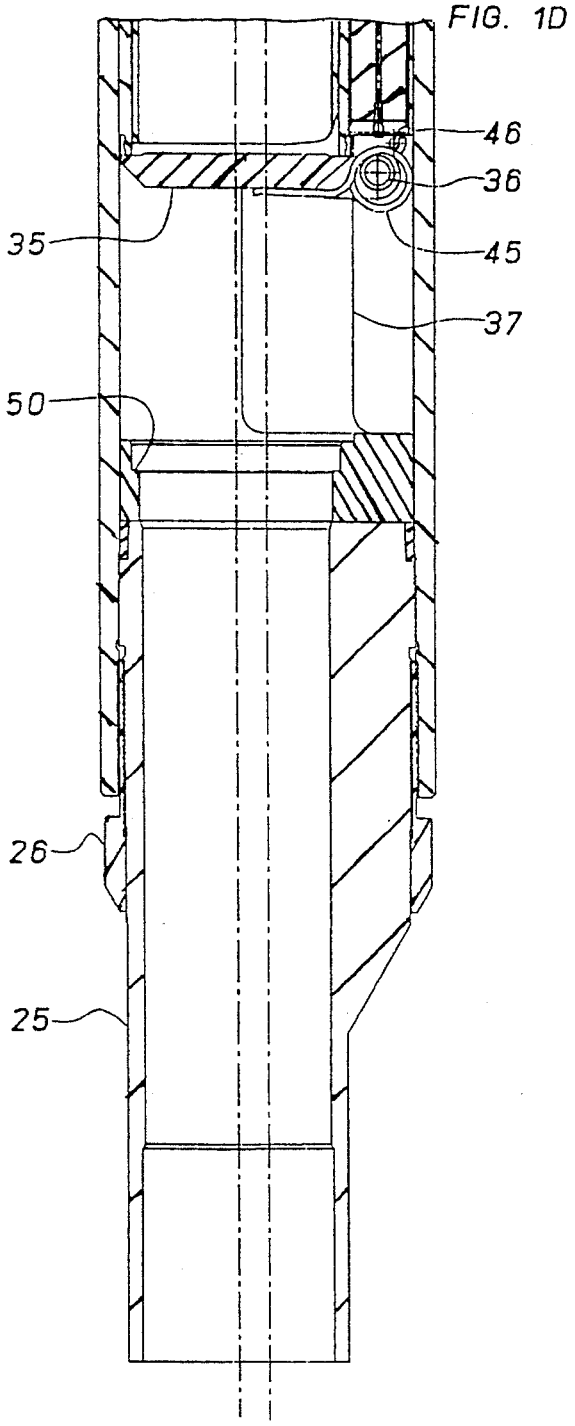
Figure 2D:
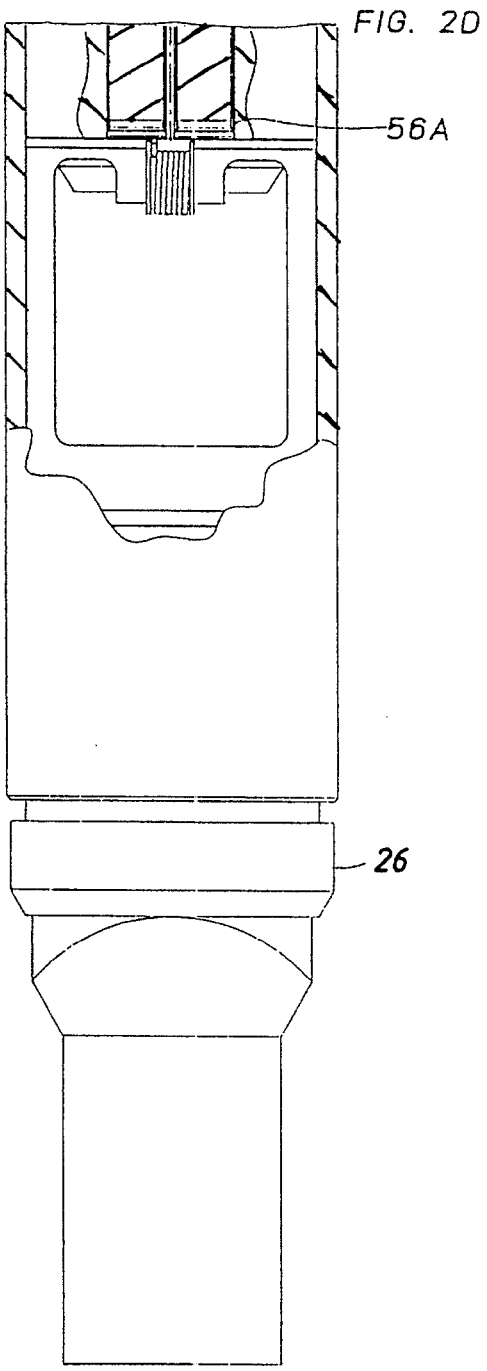
Figure 3A:
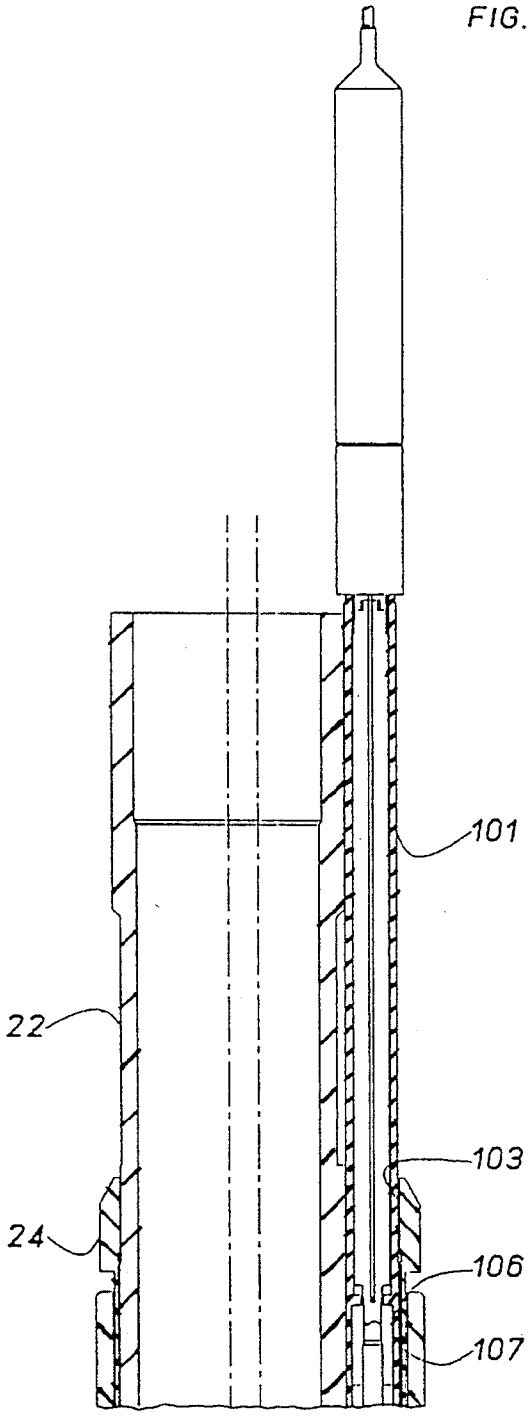
Figure 4A:
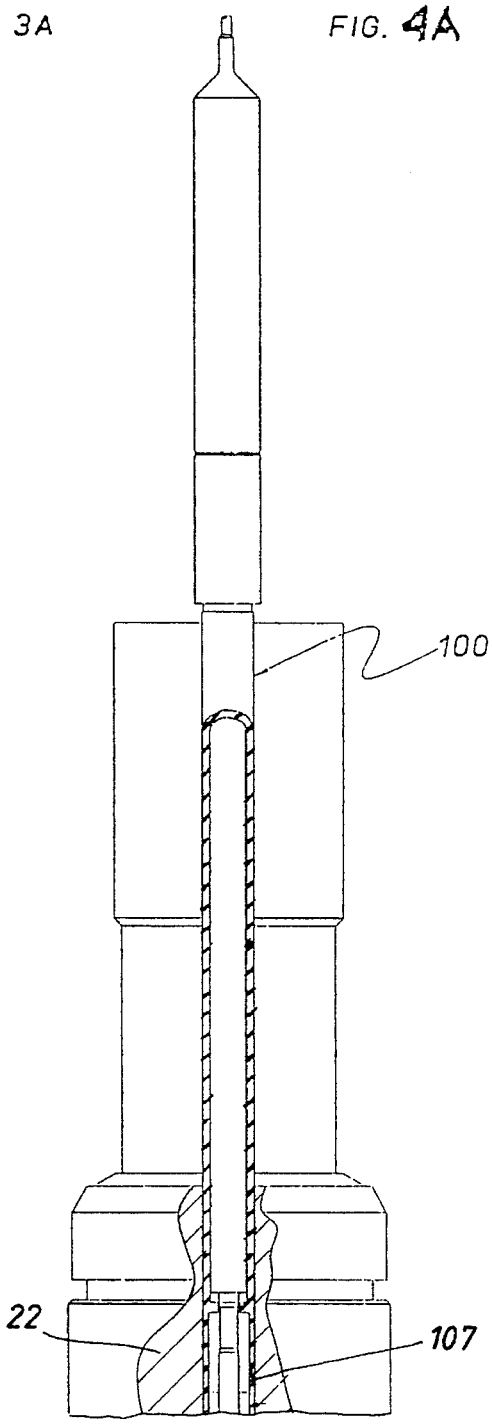
Figure 3B:
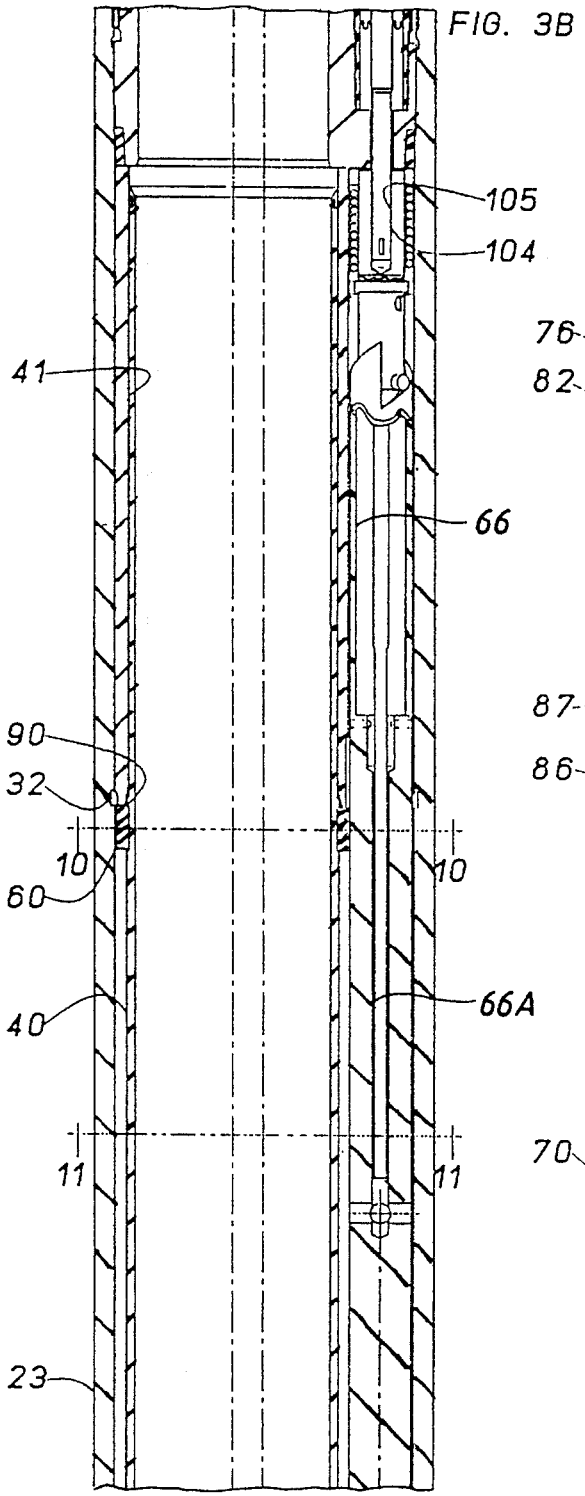
Figure 4B:
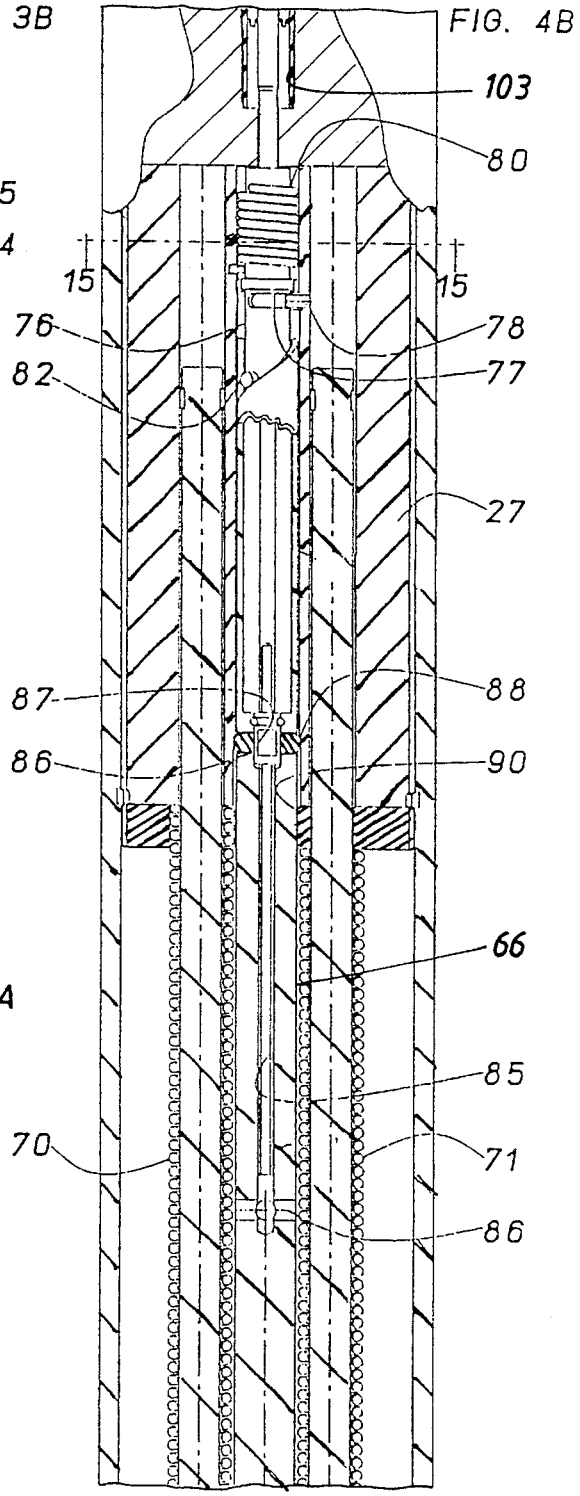
Figure 4C:
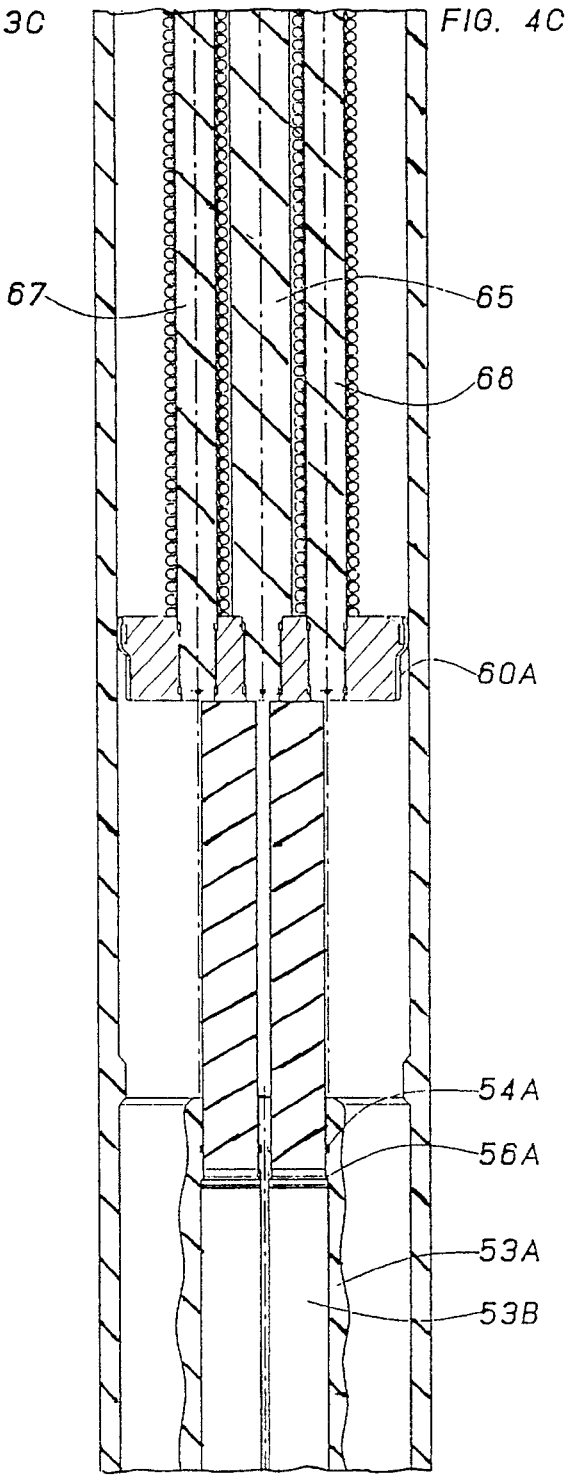
Figure 3D:
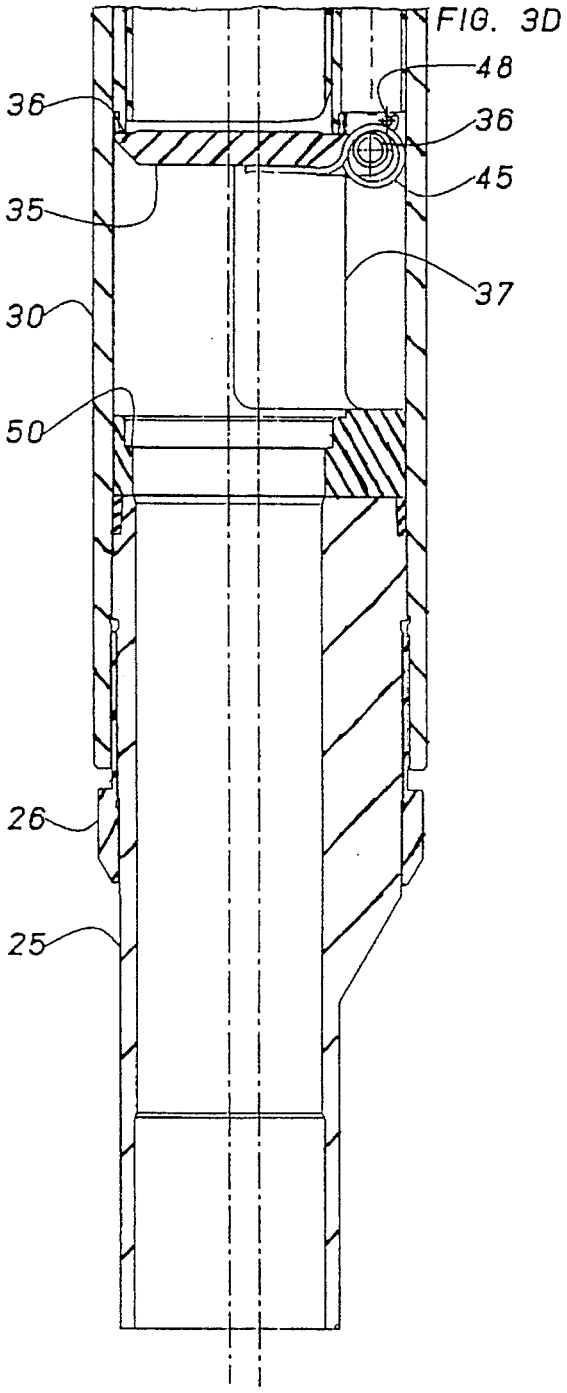
Figure 4D:
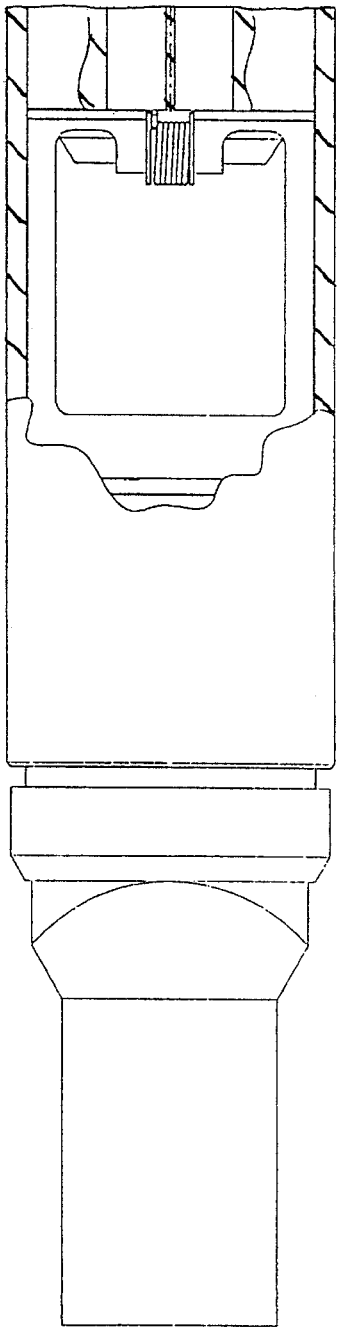
Figure 6A:
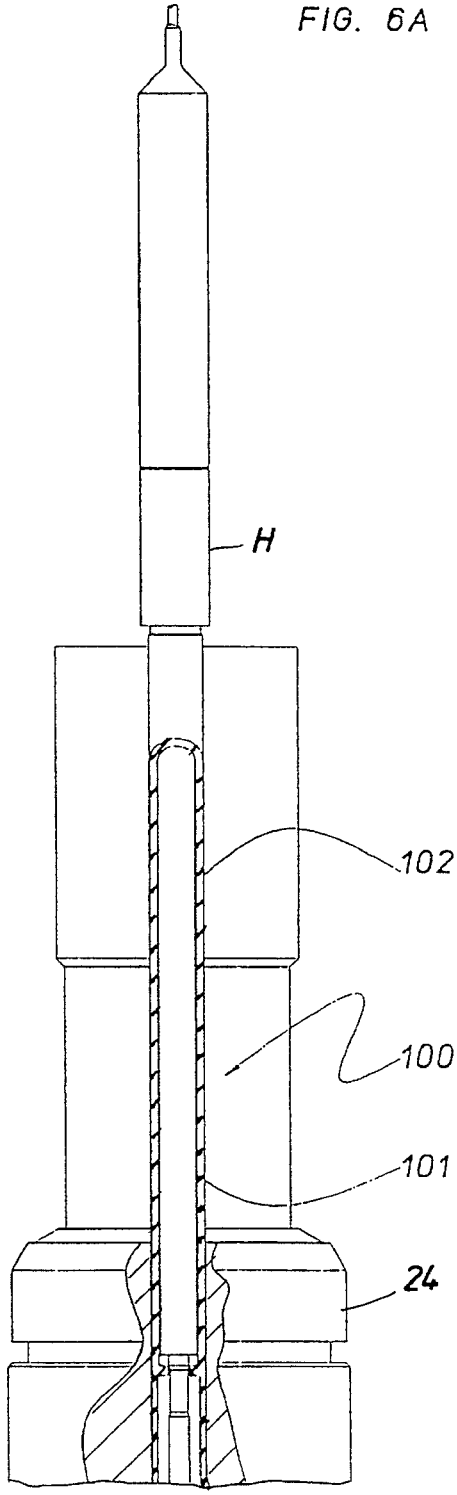
Figure 6B:
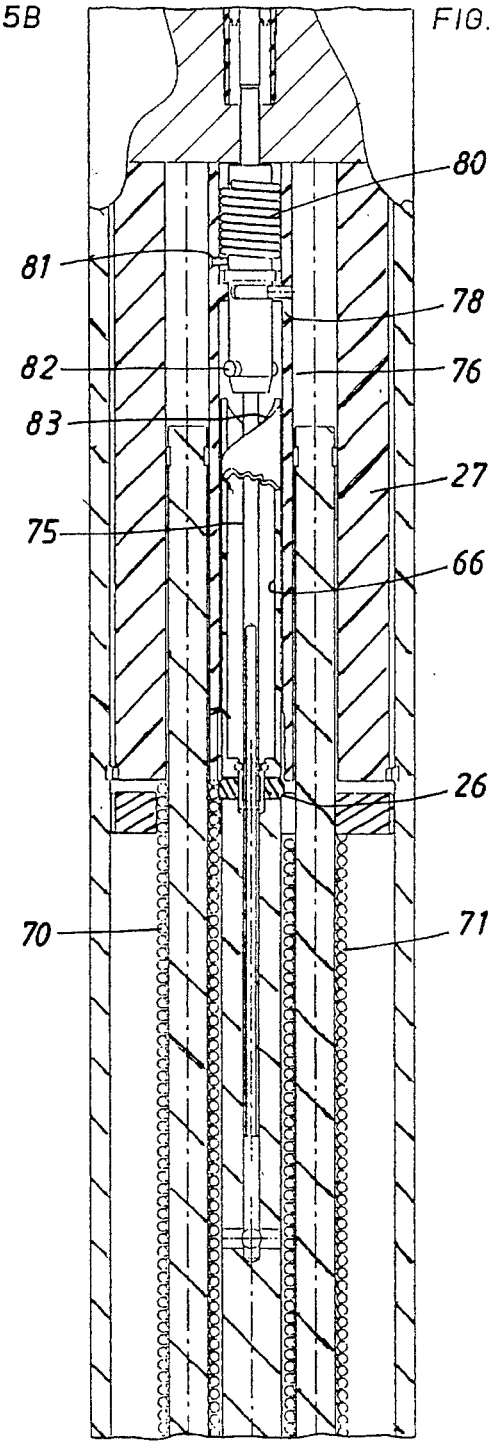
Figure 6C:
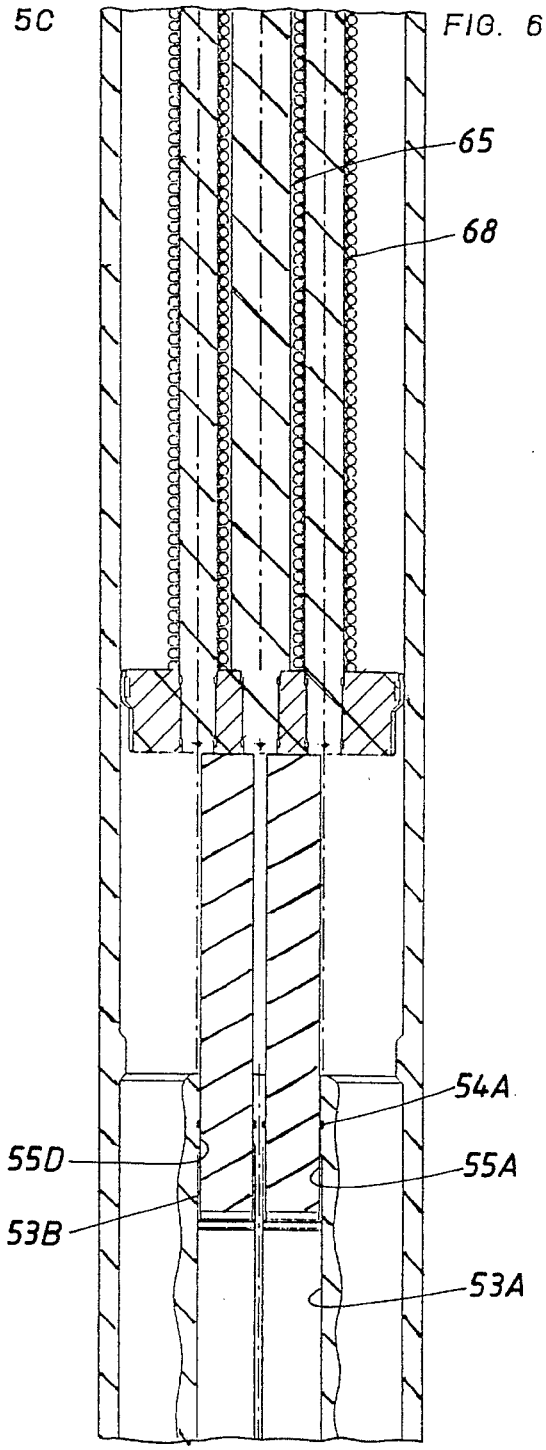

The bore in the upper plate 60 to receive the central rod has a shoulder 90 about its upper end positioned to engage the lower ends of the keys 88 when they are held in their outer positions, as shown in FIG. 4B. The pressure differential across the pistons may be decreased to permit the pistons to move downwardly by expansion of the opening and closing springs and thus permit the keys 88 to lower onto the shoulder 90 and move the lower end of the flow tube downwardly into engagement with the top side of the flapper, as shown in FIGS. 5D and 6D.

If the pressure differential is further reduced at this stage, the pistons would no longer be capable of overcoming the springs they have compressed, and the lower plate would merely move downwardly to permit the springs to return to their original positions. At the same time, the cams would move downwardly to allow the rotary control rod to be returned to its initial position which would unsupport the keys, and the valve would simply move back to the position shown in FIGS. 1A to 1D and 2A to 2D. In other words, the mere fact that the rotary control rod has been rotated and the keys expanded to a position above the shoulder 90 doesn't mean that the valve is going to stay open upon increasing the pressure above the closed flapper to reduce the pressure differential. Thus, the valve can be made ready for opening only upon activation of the control mechanism located to one side of and above the upper end of the enlarged portion of the valve housing so as to prevent the control rod from return rotation in a counter clockwise direction under the urging of the torsion spring 80.

Figure 5A:
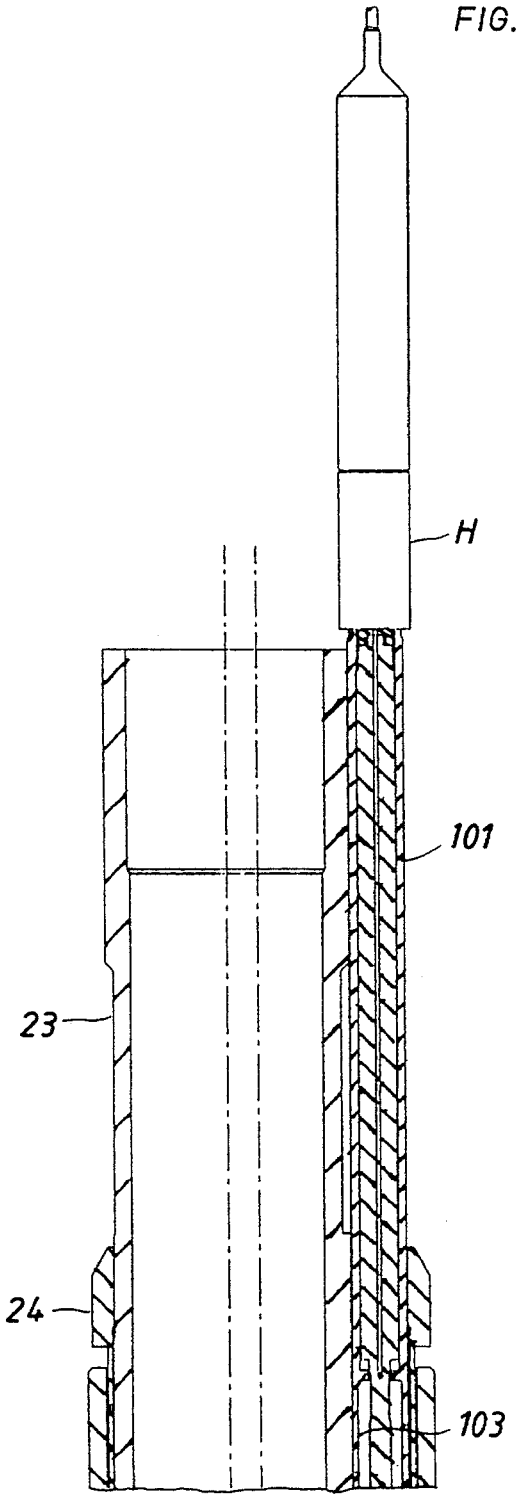
Figure 5B:
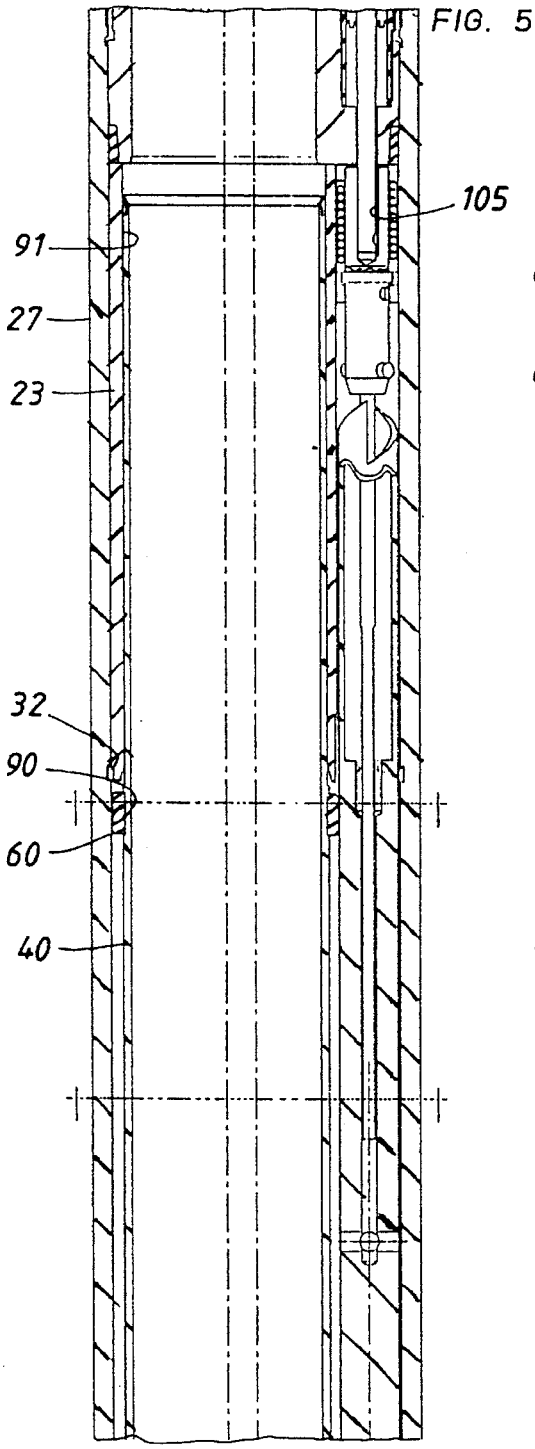
Figure 5C:
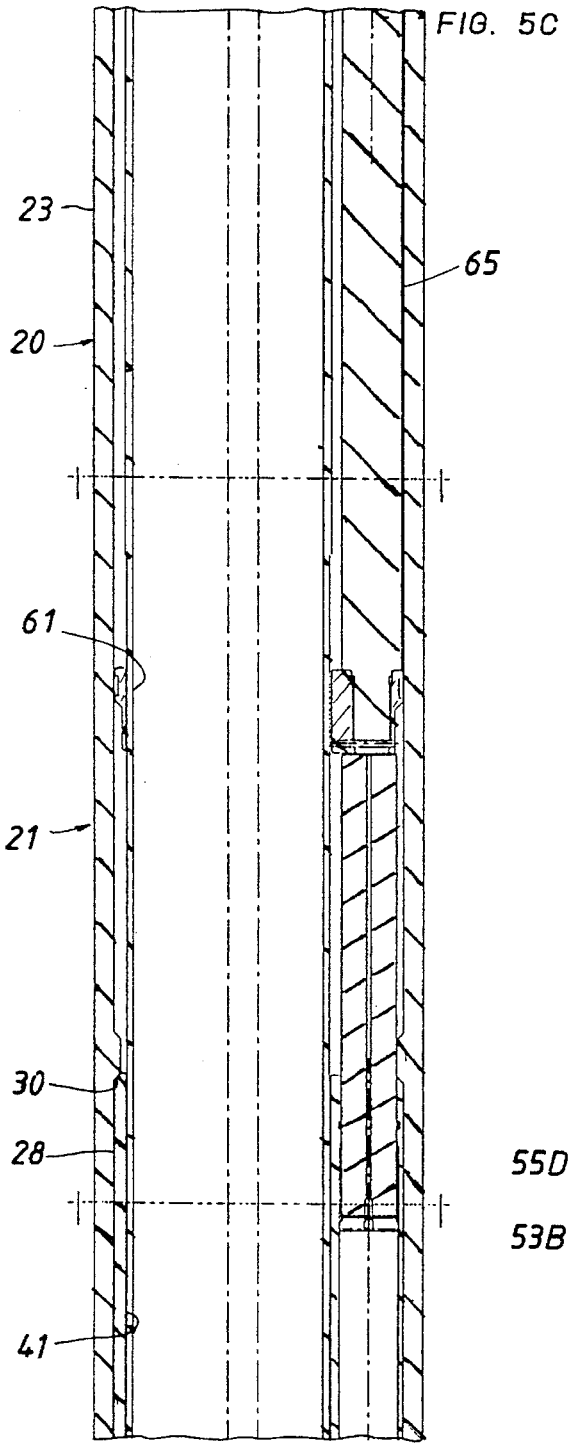
Figure 5D:
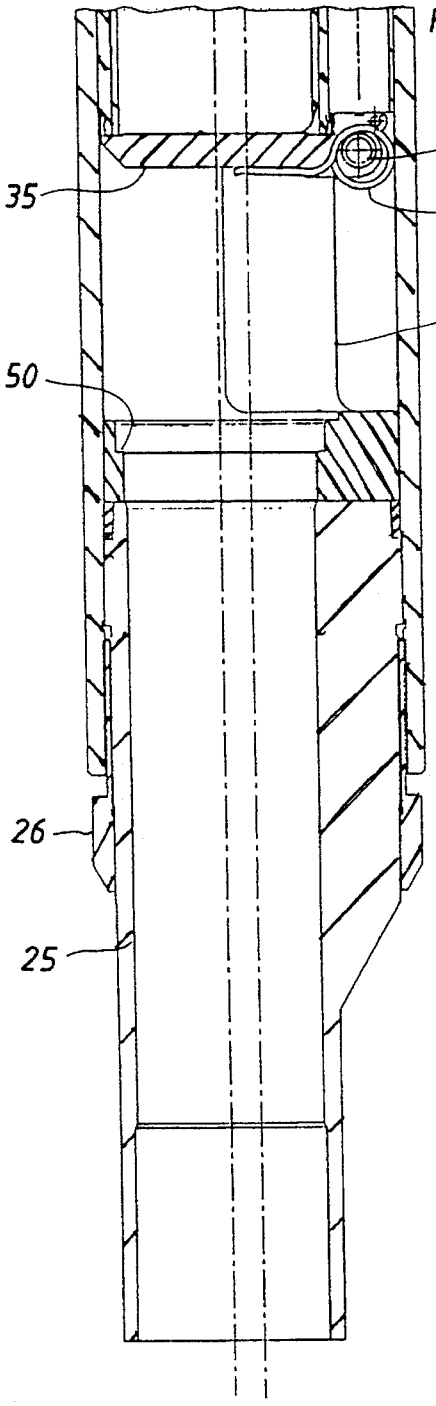
Figure 6D:
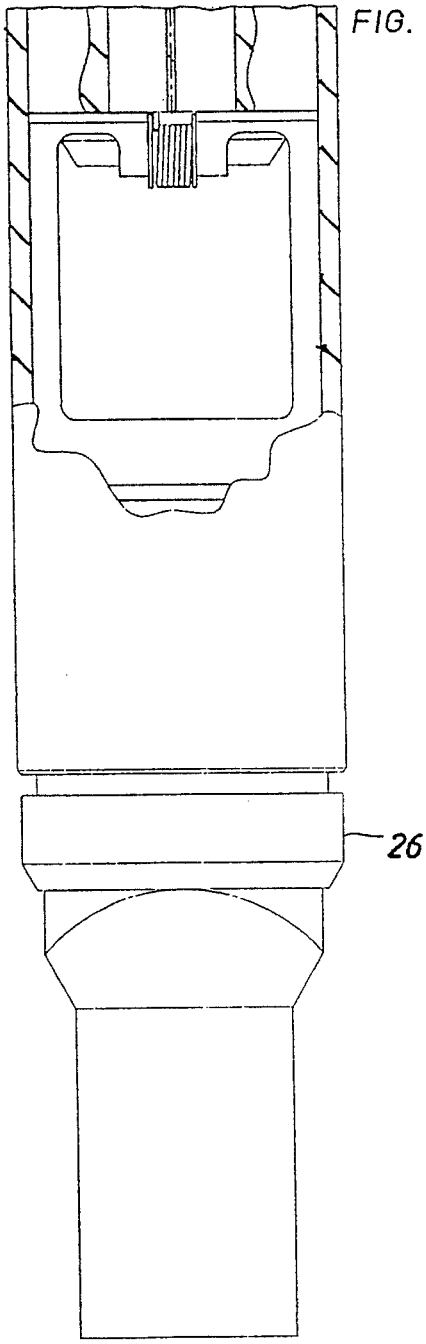
Figure 7A:
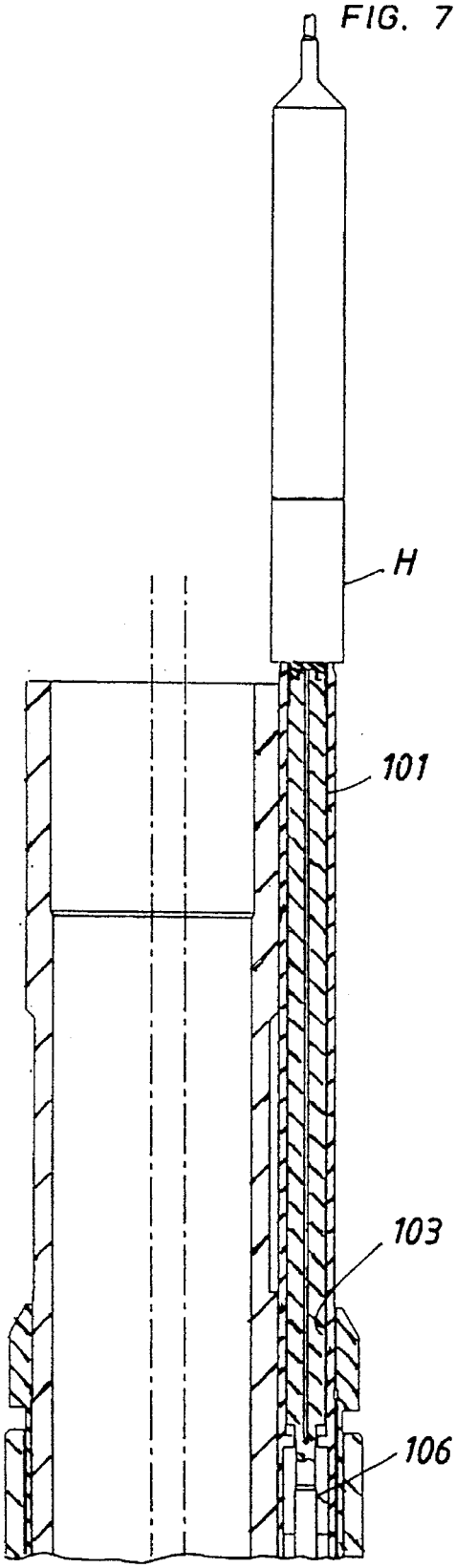
Figure 8A:
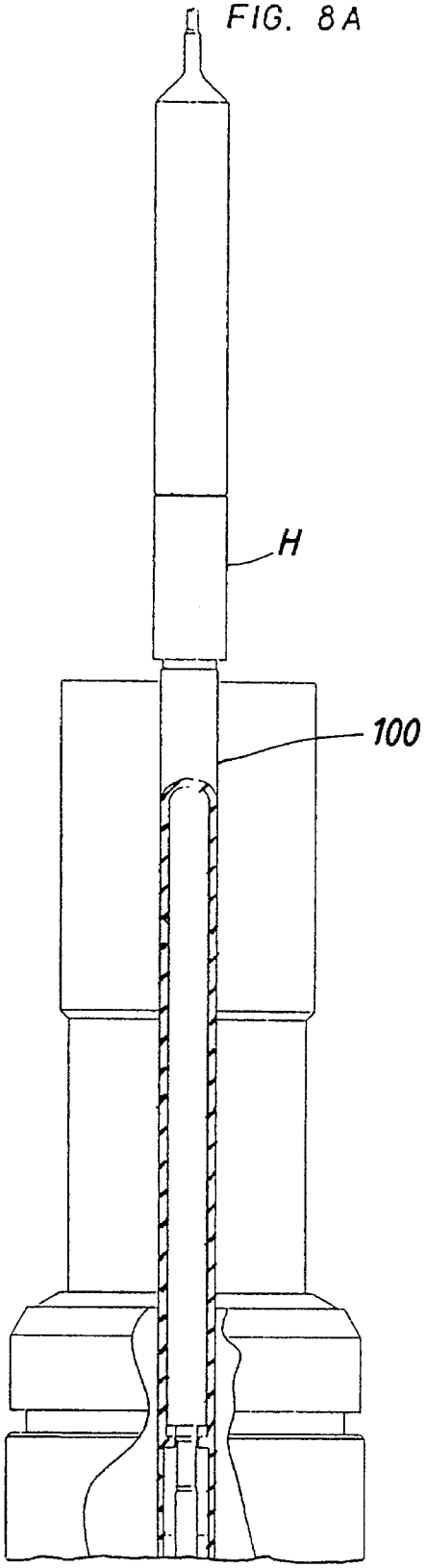
FIGS. 8A, 8B, 8C and 8D are views similar to FIGS. 7A, 7B, 7C and 7D, but viewed from the right as in FIGS. 2A to 2D.
Figure 7B:
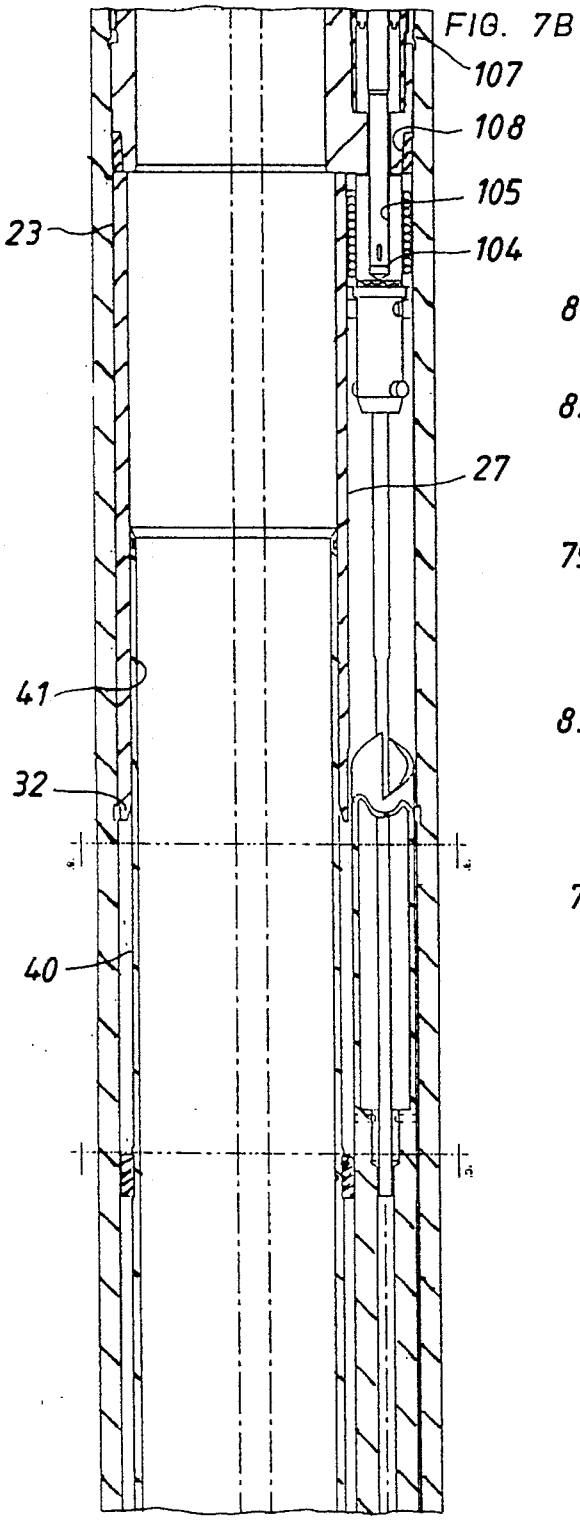
Figure 8B:
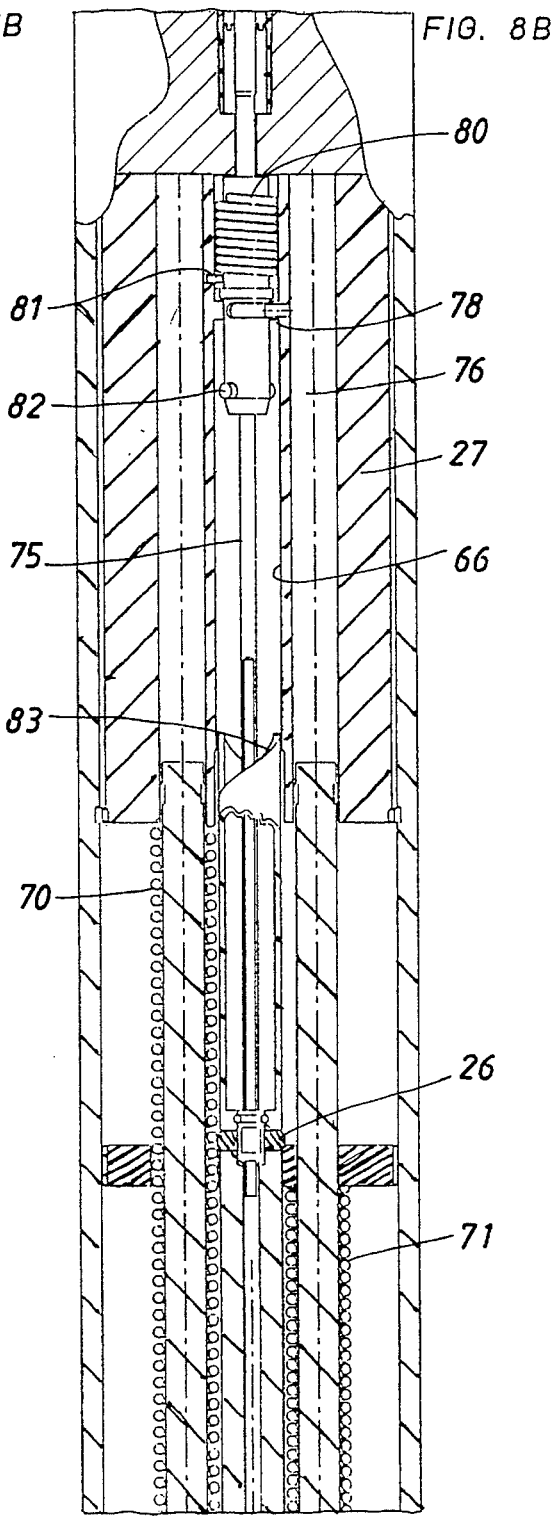
Figure 7C:
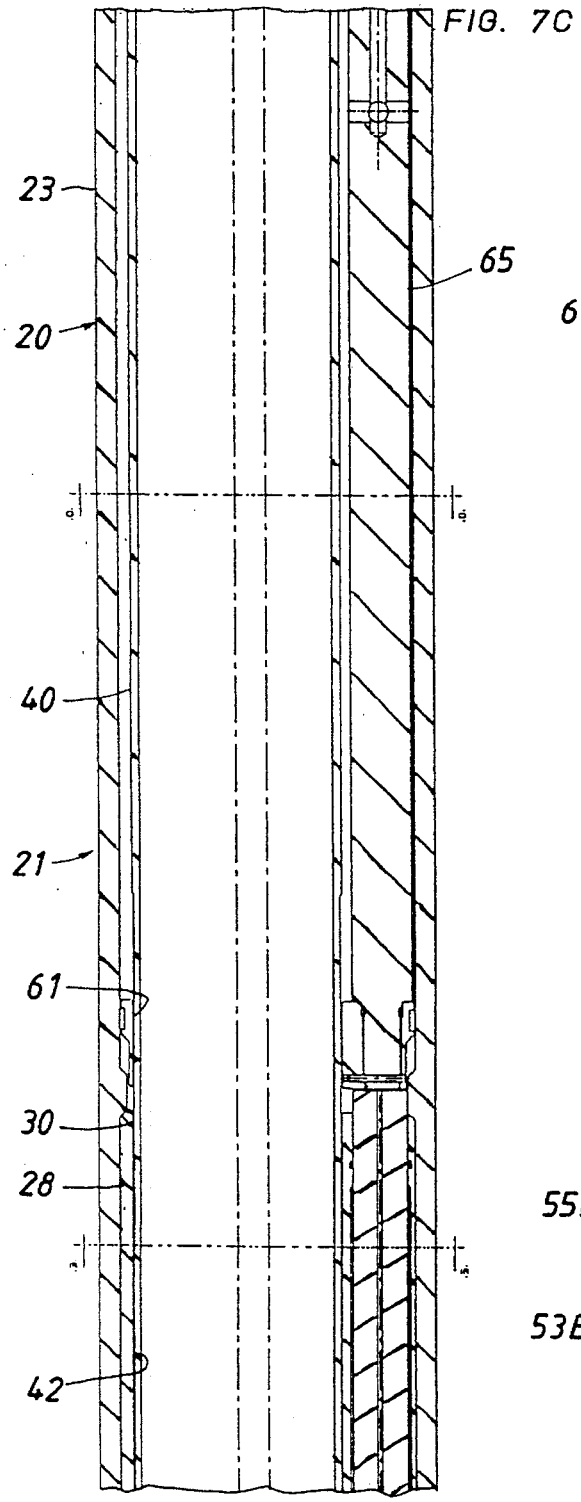
Figure 8C:
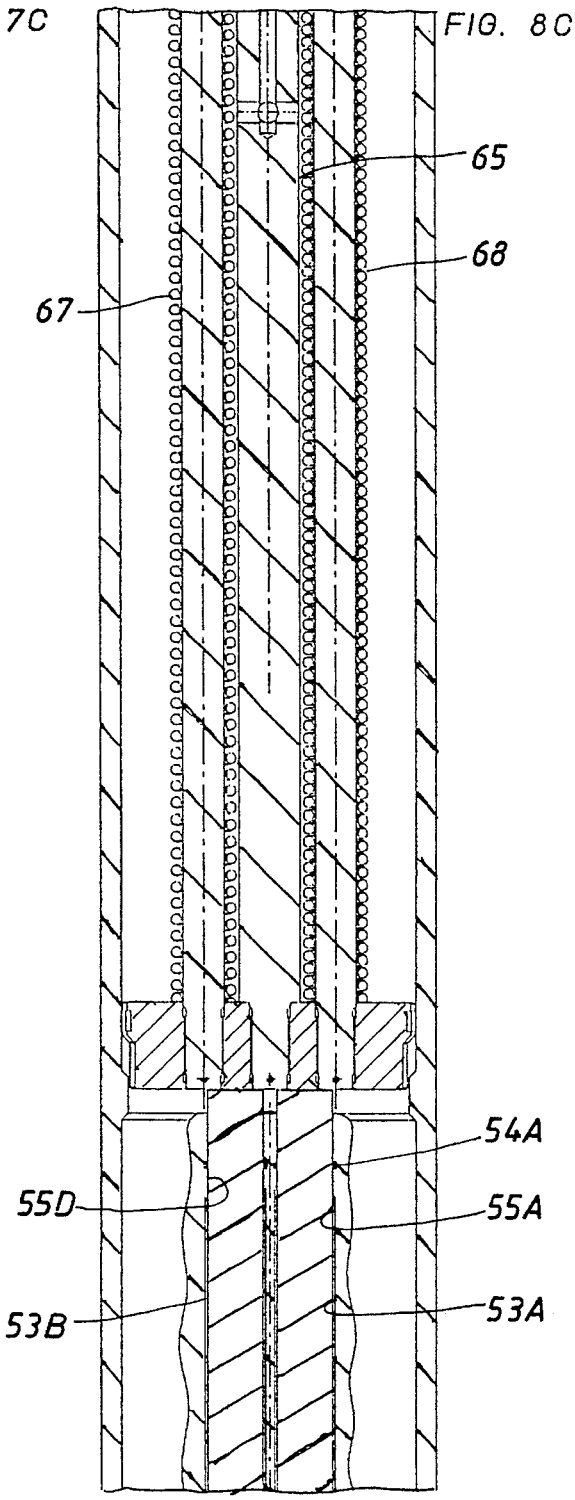
Figure 7D:
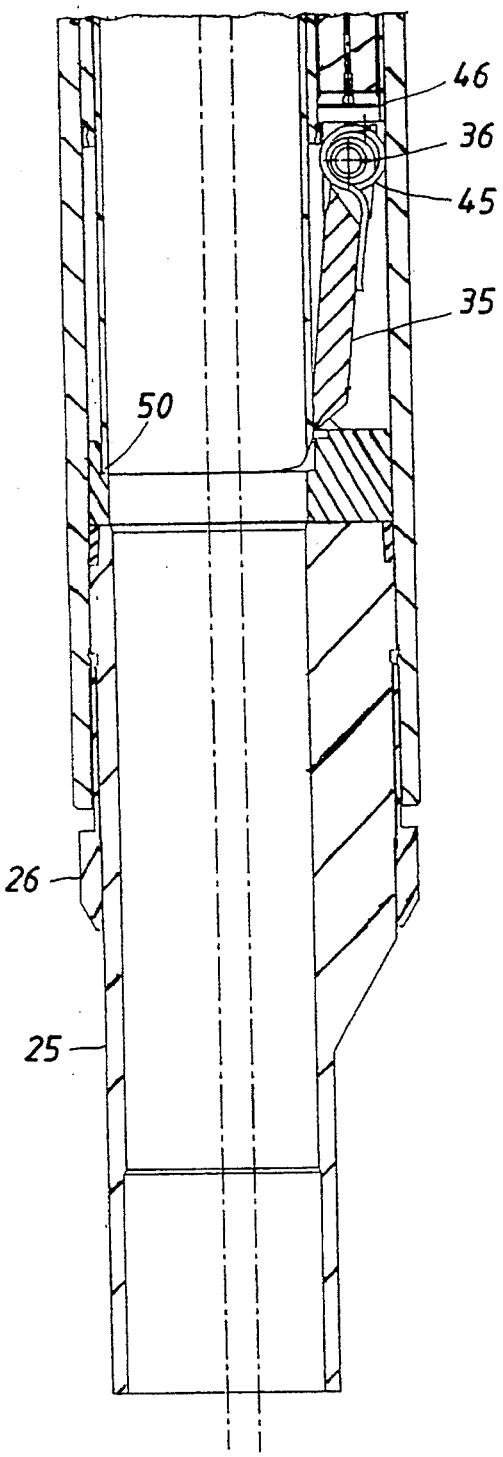
Figure 8D:
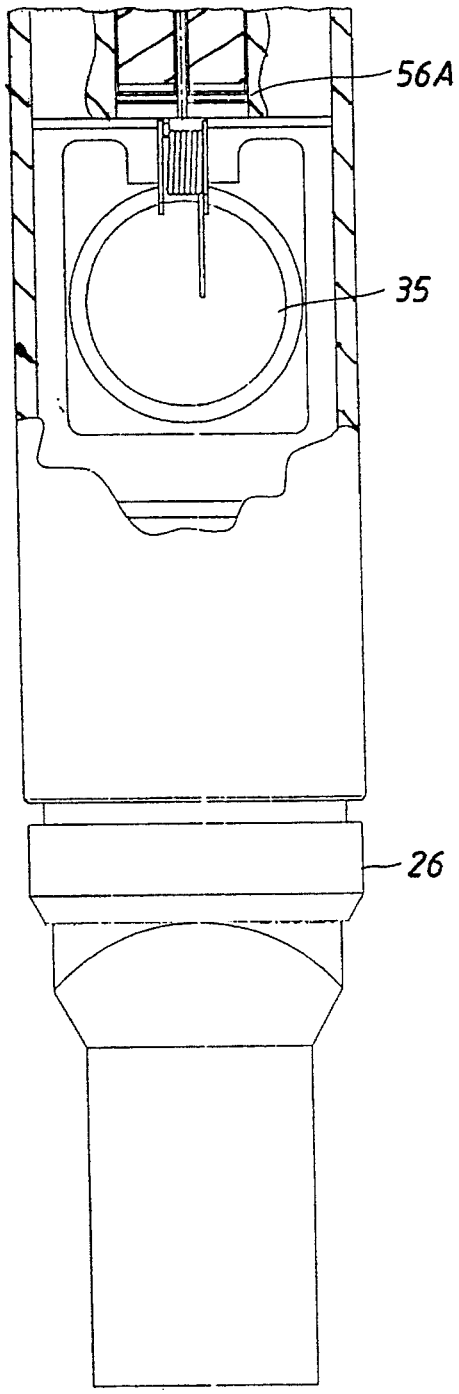

Assuming, however, that the control mechanism has been activated, as will be described to follow, to hold the rotary control rod against retrograde rotation, an increase in pressure above the closed flapper, and thus lowering the pressure differential across it, will, with the energy of the expansion of the springs, lower the pistons a short distance and thus permit the central rod 65 to lower so that the keys engage the top plate 60 to force the lower end of the flow tube downwardly against the upper side of the closed flapper, as shown in FIGS. 5D and 6D. At this time, a further increase in pressure within the flow tube above the closed flapper will, under the force of the further expanding opening spring 70, continue to lower the flow tube to move the flapper into the recess in the side of the cage beneath its hinge and thus beneath the pistons, and then continue to be lowered until it seats on shoulder 50 of the cage. As long as the controlled condition holding the control mechanism activated is maintained, the valve will remain in this full opening position of FIGS. 7A–7D and 8A–8D.

In the meantime, of course, the energy in the closing spring 71 has been maintained since it continues to be compressed between the upper and lower plates. Consequently, upon loss of the controlled condition, due to deactivation of the control mechanism, the rotary control rod is permitted to move in a counter clockwise direction. This, of course, moves the cam member to a position permitting the keys to be forced inwardly by the shoulder 90 as the lower plate and pistons are moved downwardly under the urging of the closing spring. At the same time, the expansion of the closing spring forces the upper plate upwardly to its limited position, and thus raises the flow tube to the position to permit the flapper to close, as shown in FIGS. 1A–1D.

As best shown in FIG. 21, one or more of the pistons is provided with a check valve controlled passageway 200 connecting its upper and lower ends and of such construction as to prevent locking of the pistons in their upper position (FIGS. 3C and 3D and 4C and 4D), or alternatively premature lowering of the pistons, in the event the seal ring 54A fails, as might occur if the piston is maintained in its upper position for an extended period of time, especially when well pressure below the piston is high. In this case, pressure trapped between the seal ring and the metal to metal seat below could be lost, resulting in a low pressure region between them.

If then the operator increased pressure above the flapper to open it, the region would act as an atmospheric chamber with high pressure above and below it, so that the enlarged area of the piston beneath seat 56A would prevent lowering of the pistons to open the valve. Hence, in accordance with the present invention, and as best shown in FIG. 21, there is a downwardly opening ball check 201 in the passage enabling high pressure above it to enter the region through passageways 202. As also shown, a plug 205 in the lower end of the passageway 200 beneath its connection with passageways 202 confine the pressure passing ball check 201 to flow into the region between the metal and elastomeric seats until the pressure across valve 201 is equalized.

The control mechanism, which is indicated in its entirety by reference character 100, comprises a tubular body 101 which extends into a guide opening 103 in the upper end of offset portion of tubular member 22 for connection within a socket in the lower end of the opening. As shown, a control rod 102 extends downwardly from the body 101 to connect with the upper end of the rotary control rod 75 in the valve housing. Thus, the lower end 104 of the rod 102 extends into and is secured to an upwardly facing hole 105 in the upper end of the rotary control rod 75. The lower end of the control mechanism rod 102 is separated from well pressure by a piston 107 slidable thereabout within an oil chamber 106 and guided in an opening 108 above the socket.

As shown in FIGS. 16–20 the upper end of the control mechanism rod 102 rotates within bearings 103A received in the lower end of a stator 104A mounted within and fixed to a housing H of the control mechanism. Aligned cylindrical surfaces on the stator 104A and rod 102 are surrounded by a wrap spring 105A whose lower end fits closely about the cylindrical surface of the rod 102 and whose upper end fits relatively loosely about the lower end of the stator 104A prior to activation of the control mechanism, whereby prior to activation of the control mechanism, the spring merely slips to permit clockwise rotation of the control rod 102.

As shown in FIGS. 19 and 20 the upper end of the wrap spring has a tang 110 received in a slot 110A in the lower end of a control body 111 which is rotatably mounted about the stator. This control body is urged downwardly by means of a coil spring 113 held between shoulder 114 on the control body and a ring 115 beneath a ratchet wheel 116. Friction pads 117 and 117A are disposed between the ring and the ratchet wheel and between the ratchet wheel and an inward and outwardly extending flange on the control body extension 111A. The compression of the spring 113 between bearings 117B and the control body maintains the pads in a frictional engagement with their adjacent surfaces so as to normally prevent rotation between the control body and the ratchet wheel.

The ratchet has teeth 118 on its upper side which are in position to be engaged by the lower end of a pin 119 extending downwardly through the stator. The pin is moved from its upper to its lower position by means of a clapper or arm 130 mounted on the stator for swinging about its right side, as shown in FIGS. 19 and 20. A coil 131 surrounding a core 131A of the stator may be electrically excited, as will be described, to draw the clapper downwardly against a stop 132 to close the air gap between them and thus lower the lower end of the pin into position to engage the teeth on the ratchet wheel. Obviously, upon deactivation of the electromagnet, the clapper rises to restore the air gap and thereby permit the pin to be forced upwardly by the inclined surfaces of the ratchet teeth to the position shown in FIG. 19, as will be described to follow.

As shown in FIGS. 16A and 16B, the electromagnet is energized by direct current supplied thereto through wiring 135 received from a rectifier 136 which in turn is wired to an induction coupling 137 to which alternating current is supplied through wiring 138. Thus, the electrical wiring does not have to penetrate the wall of the control mechanism, separating the coils, which of course is of particular advantage in the case of underwater installations. The wiring 138 extends through a hole 139 in the upper end of the body 101 for connection to a suitable source of alternating current at the surface. As above noted, removal of that current due to the loss of the controlled condition will deactivate the mechanism to permit the pin 119 to move up from engagement with the ratchet teeth. The controlled condition may be lost in any number of ways, as well known in this art.

Preferably, and as best shown in FIGS. 19 and 20, the ratchet teeth are arranged in position to receive one end of a dog on a plunger 155 mounted in the stator and urged downwardly toward the ratchet by means of a coil spring 157. This coil spring need not provide enough energy to actually move the ratchet wheel, but merely locate its teeth in position to receive one end of the pin 119, which is held down to engage the ratchet as above described. In particular, it insures that the lower end of the pin initially engages an inclined surface just to the left of an abrupt surface.

FIGS. 17A and 17B and 18A and 18B illustrate alternative embodiments of a control mechanism for wrapping the spring down on the rod when activated by a suitable signal in response to a controlled condition. Thus, in the control mechanism shown in FIG. 17A and 17B, the upper end of pin 119 is adapted to be moved downwardly to engage the ratchet by means of a flange 200 having a lower guide 210 received in a space 211 in the body above the stator. The flange is urged downwardly by a spring 214 compressed between it and a plate 215 on the lower end of a bellows 216. The bellows is adapted to be filled with oil through a port 218 connecting with an oil chamber 219 at its upper end, whereby pressurization of the oil in the chamber will lower the bellows and thus the plate so as to compress the spring 214 and lower the flange 200 and thus the pin 109.

The chamber has a curved side 219 opposite a stop surface 220 on its upper end. An opening 221 in the upper end of the body connects with tubing leading to a diaphragm 222 across the chamber to receive hydraulic fluid from a suitable at the wellhead, which urges the bellows downwardly to lower the pin 109. The lower curved surface in the chamber limits the extent to which the diaphragm maybe deformed by hydraulic fluid from the surface and thus the load which may be supplied to the bellows.

Figure 17A:
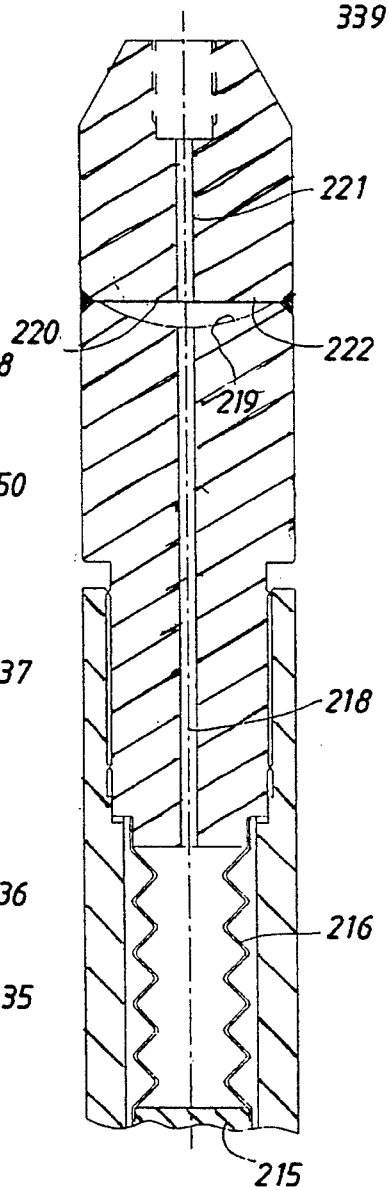
FIGS. 17A and 17B are views similar to FIGS. 16A and 16B of an alternative form of control mechanism.
Figure 17B:
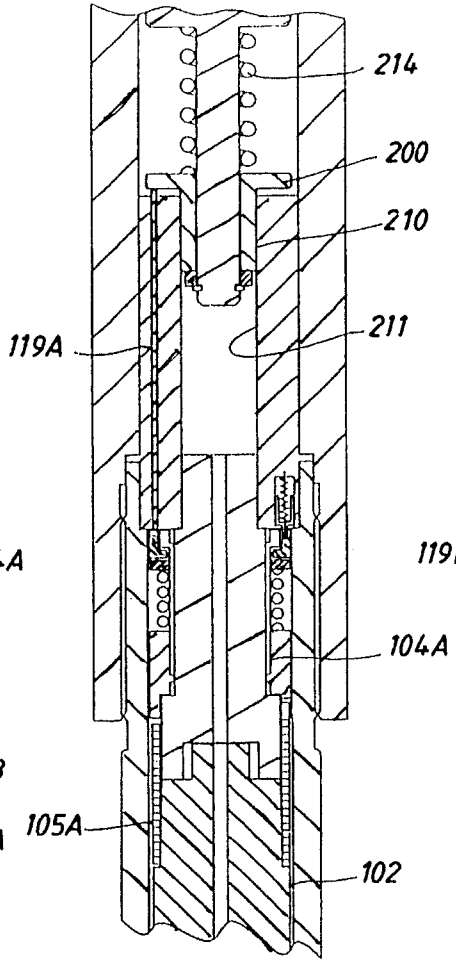

The third embodiment of the control mechanism shown in FIGS. 18A and 18B embodies a combination of the hydraulic features of the mechanism of FIGS. 17A and 17B and the magnetic features of FIGS. 16A and 16B. Thus, in this case, a vertically shiftable member 330 has a flange 331 about its lower end above the upper end of pin 119A, and a head 332 at its upper end above a U shaped post 333 above the flange which is made of a magnetic material not having residual magnetism. The flange 331 is lowered to lower the rod 109 in response to excitement by an inverted permanent magnet 335 below a bellows 336 within an atmospheric chamber. Upon lowering of the magnet 335, the member 333 is excited to in turn lower the flange on member 330 to lower pin 109.

The bellows is filled with hydraulic fluid supplied thereto through a passageway 338 leading from a chamber 337. A diaphragm extends across the chamber to divide it into a lower portion connecting with passageway 338 and on upper portion connecting with a passageway leading to a source of hydraulic fluid at the surface. Thus, such fluid is supplied to the upper side of the diaphragm to lower the bellows, and thus pin 119A, in response to activation of a signal indicative of a controlled condition. As shown, the upper and lower surfaces of the chamber are curved to limit deflation of the diaphragm in both directions.

The operation of the control mechanism is common to each of the embodiments, except for the means by which the pin 119B is lowered or raised in response to activation or deactivation of a signal from a remote source indicative of the maintenance of a controlled condition. As previously described, since the upper end of the wrap spring 105 has clearance about the stator, it will permit the control body to rotate. However, if that body is locked against rotation, and the control rod tries to rotate in a counter clockwise direction to a release position, the upper end of the spring will wrap down to lock the stator body to the control body 102. The spring 113 and friction pads 117 and 118 cause the ratchet wheel to rotate with the control body in the absence of a counter force overcoming them.

As the control rod 102 rotates clockwise in a resetting direction, the spring loaded dog 155 engages an abrupt surface on a ratchet tooth to locate them in a position in which the lower end of pin can be lowered without interference onto an inclined surface on a tooth, as shown in FIG. 22A. In the direction of resetting, the dog will engage the ratchet wheel and prevent it from rotating. As the valve resets, either the wrap spring on its lower end will slip on the control rod 102, or the friction pads will slip. However, if the signal is not activated and pressure differential is removed from across the closed valve, the dog will slip on the inclined surfaces of the ratchet wheel and allow the wrap spring to rotate and not lock the valve control mechanism.

Upon activation, the ratchet wheel, being rotationally locked through the friction pads, will effectively lock the upper end of the wrap spring such that if pressure differential is removed from across the flapper, the control rod 102 will be prevented from returning to the release position since, as noted, the wrap spring will wrap down and rotationally lock the rotary control rod 102 to the stator. The torsion spring within the valve housing, of course, will be continuing to urge the control rod to the release position, and the pin 119, is taking torque on the inclined surface of a tooth of the ratchet wheel 116. Thus, the very low torque which causes the wrap spring to wrap down is creating a load on the inclined surface of the ratchet tooth trying to urge the pin 119 up.

However, if the signal is removed due to loss of the controlled condition, the resistance of the wrap spring will cause the ratchet teeth to rotate to the FIG. 22B position to raise the pin 119 and thus release the ratchet wheel. This will then allow the wrap spring to unwrap and unlock the control rod 102 from the stator. Thus, the electromagnet other power source activated by the signal and does not work, except clamp the wrap spring down i.e., it does not have to push a spring or wrap a spring down or force anything to happen. It simply closes up its air gap and prevents the retrograde movement of the ratchet wheel.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A subsurface tubing safety valve, comprising an elongate housing connectible as part of a tubing string disposable within a well bore and having a flowway therethrough and a diametrically enlarged portion intermediate its ends, upper and lower guide bodies received in the enlarged portion of the housing each having bores therethrough aligned with the flowway, a flapper pivotally mounted on the housing for swinging between a first position to open the flowway and a second position to close the flowway, spring means acting between the housing and flapper to urge it closed, a lower plate above the lower guide body and having a bore therethrough aligned with the bore of the lower guide body, an upper plate below the upper guide body and having a bore therethrough aligned with the bore of the upper guide body, a flow tube secured to the upper plate and extending through the bores in the lower plate and lower guide body for reciprocating therein so that, when lowered, its lower end moves the closed flapper to open position, piston means sealably reciprocable within the lower guide body so as to be urged upwardly in response to well pressure beneath them, first, second and third rods extending upwardly from the lower plate through the upper plate and into the upper guide body, an opening coil spring about the second rod and extending through the upper plate to engage at opposite ends with the lower plate and upper guide body, a closing coil spring about the third rod to engage at opposite ends with the upper and lower plates, a control rod extending within the first rod for rotation with respect thereto, means on the upper guide body and control rod yieldably urging the control rod in one direction to a first limited rotational direction, means on the control rod and second rod for rotating the control rod in the other direction to a second limited rotational position upon raising of the second rod as the pistons are raised in response to an increase in differential across the closed flapper, means operable, upon rotation of the control rod to its second position, and lowering of the pressure differential, to prevent downward movement of the second rod with respect to the upper plate and thus to store energy in both springs as they are compressed by raising of the lower plate, and a control mechanism mounted on the housing including means activated in response to a signal representing a controlled condition so as to prevent rotation of the control rod in the other direction, whereby, as long as said means is activated, the pressure differential may be reduced to permit the opening spring to lower the lower plate and pistons and thus the flow tube to open the flapper, the deactivation of the signal releasing the second rod from the upper plate to permit the closing spring to raise the flow tube and thus permit the flapper to close.

2. A subsurface tubing safety valve of the character defined in claim 1, wherein the control mechanism comprises a body mounted on the housing and having a second control rod therein rotatable with the first mentioned control rod in the housing and a part fixed to the body, a control body surrounding said fixed part, a wrap spring having one portion disposed closely about a cylindrical surface on the fixed body part and another portion loosely disposed about an aligned cylindrical surface on the second control rod and held at the end of its one portion, whereby said second control rod is free to rotate in said one direction but is held against rotation in the other direction, a ratchet wheel, spring means acting between the ratchet wheel and control body, a pin mounted on the control body for reciprocation between positions in which one end is engaged and disengaged with the ratchet teeth, means responsive to activation of a signal indicative of the failure of the controlled condition to force the one end of the pin against the ratchet teeth and thereby restrain the ratchet wheel from rotation in said other direction, means yieldably urging the ratchet wheel toward the end of the pin, and means disposed between the ratchet wheel and control body to frictionally engage the ratchet wheel for rotation with the control body in said one direction but permit rotation of the control body with respect thereto in the other direction.

3. A subsurface tubing safety valve of the character defined in claim 2, including a dog mounted on the body of the control mechanism in position to move into and out of engagement with the ratchet teeth,, and means yieldably urging the dog into engagement with the ratchet teeth so that it will engage an abrupt surface thereof as the ratchet rotates with the control body and thus locate the ratchet wheel in a position in which the end of the pin engages an inclined surface of a tooth.

4. A subsurface tubing safety valve, comprising an elongate housing connectible as part of a tubing string disposable within a well bore and having a flowway therethrough and a laterally enlarged cylindrical portion on one side of the flowway intermediate its ends whose axis is eccentric to the flowway to provide a space between them, upper and lower guide bodies received in the enlarged portion of the housing each having bores therethrough aligned with the flowway, a flapper pivotally mounted on the housing for swinging between a first position engaged with a seat about the bore of the lower body to close the flowway and a second position within a recess in the housing beneath the space to open the flowway, spring means acting between the housing and flapper to urge it closed, a lower plate above the lower guide body and having a bore therethrough aligned with the bore of the lower guide body, an upper plate below the upper guide body and having a bore therethrough aligned with the bore of the upper guide body, a flow tube secured to the upper plate and extending through the bores in the lower plate and lower guide body for reciprocating therein so that, when lowered its lower end engages and swings the closed flapper into the recess to open the flowway, said lower guide body having additional bores therethrough connecting the space with the lower end of the housing outside of the seat, pistons sealably reciprocable in the additional bores so as to be urged upwardly in response to well pressure beneath them, said upper body having additional bores therethrough, first, second and third rods extending upwardly from the lower plate and through the upper plate within the space and into the additional bores of the upper guide body, an opening coil spring about the second rod and extending through the upper plate to engage at opposite ends with the lower plate and upper guide body, a closing coil spring about the third rod to engage at opposite ends with the upper and lower plates, a control rod extending within the first rod for rotation with respect thereto, means on the upper guide body and control rod yieldably urging the control rod in one direction to a first limited rotational position, means on the control rod and second rod for rotating the control rod in the other direction to a second limited position upon raising of the second rod as the pistons are raised in response to an increase in differential across the closed flapper, means operable, upon rotation of the control rod to its second position, and lowering of the pressure differential, to prevent downward movement of the second rod with respect to the upper plate and thus to store energy in both springs as they are compressed by raising of the lower plate, and a control mechanism mounted on the housing to one side of the upper portion thereof and above the space including means activated in response to a signal representing a controlled condition so as to prevent rotation of the control rod in the other direction, whereby, as long as said means is activated, the pressure differential may be reduced to permit the opening spring to lower the lower plate and pistons and thus the flow tube to open the flapper, the deactivation of the signal releasing the second rod from the upper plate to permit the closing spring to raise the flow tube and thus permit the flapper to close.

5. A subsurface tubing safety valve of the character defined in claim 4, wherein the control mechanism comprises a body mounted on the housing and having a second control rod therein rotatable with the first control rod in the housing and a part fixed to the body, a control body surrounding said fixed part, a wrap spring having one portion disposed closely about a cylindrical surface on the fixed body part and another portion loosely disposed about an aligned cylindrical surface on the second control rod and held at the end of its one portion, whereby said second control rod is free to rotate in said one direction but is held against rotation in the other direction, a ratchet wheel, spring means acting between the ratchet wheel and control body, a pin mounted on the control body for reciprocation between positions in which one end is engaged and disengaged with the ratchet teeth, means responsive to activation of a signal indicative of the failure of the controlled condition to force the one end of the pin against the ratchet teeth and thereby restrain the ratchet wheel from rotation in said other direction, means yieldably urging the ratchet wheel toward the end of the pin, and means disposed between the ratchet wheel and control body to frictionally engage the ratchet wheel for rotation with the control body in said one direction but permit rotation of the control body with respect thereto in the other direction.

6. A subsurface safety valve of the character defined in claim 5, including a dog mounted on the body of the control mechanism in position to move into and out of engagement with the ratchet teeth, and means yieldably urging the dog into engagement with the ratchet teeth so that it will engage an abrupt surface thereof as the ratchet rotates with the control body and thus locate the ratchet wheel in a position in which the end of the pin engages an inclined surface of a tooth.

7. In a valve which includes a housing having a flowway therethrough, a closure member moveable between positions opening and closing the flowway, means including a first control rod rotatable in one direction within the housing from one position to which it is yieldably urged to another for generating energy in response to a pressure differential across the closure member while the closure member is in closed position, means operable upon a reduction in the pressure differential, for releasing generated energy in order to move the closure member from closed to open position and hold it in open position so long as the rod is held in said other position by maintenance of a controlled condition, and means operable, upon the loss of said controlled condition to release said rod for rotation back to its one position, for releasing further generated energy in order to move the closure member from open to closed position, a control mechanism for so holding and releasing the rod, comprising a body mounted on the housing and having a second control rod therein rotatable with the first control rod in the housing and a part fixed to the body, a control body surrounding said fixed part, a wrap spring having one portion disposed closely about a cylindrical surface on the fixed body part and another portion loosely disposed about an aligned cylindrical surface on the second control rod and held at the end of its one portion, whereby said second control rod is free to rotate in said one direction but is held against rotation in the other direction, a ratchet wheel, spring means acting between the ratchet wheel and control body, a pin mounted on the control body for reciprocation between positions in which one end is engaged and disengaged with the ratchet teeth, means responsive to activation of a signal indicative of the failure of the controlled condition to force the one end of the pin against the ratchet teeth and thereby restrain the ratchet wheel from rotation in said other direction, means yieldably urging the ratchet wheel toward the end of the pin, and means disposed between the ratchet wheel and control body to frictionally engage the ratchet wheel for rotation with the control body in said one direction but permit rotation of the control body with respect thereto in the other direction.

8. In a valve of the character defined in claim 7, wherein the control mechanism also includes a dog mounted on the control body of the control mechanism in position to move into and out of engagement with the ratchet teeth, and means yieldably urging the dog into engagement with the ratchet teeth so that it will engage an abrupt surface thereof as the ratchet rotates with the control body and thus locate the ratchet wheel in a position in which the end of the pin engages an inclined surface of a tooth.

9. For use in apparatus having a housing in which a first control rod is adapted to be rotated in one direction from one limited position to another position and is yieldably urged in the other direction from said other position to said one position, a control mechanism for releasably holding said first control rod in said other position as long as a signal representing a controlled condition is maintained, said mechanism comprising a body mounted on the housing and having a second control rod therein rotatable with the first control rod in the housing and a part fixed to the body, a control body surrounding said fixed part, a wrap spring having one portion disposed closely about a cylindrical surface on the fixed body part and another portion loosely disposed about an aligned cylindrical surface on the second control rod and held at the end of its one portion, whereby said second control rod is free to rotate in said one direction but is held against rotation in the other direction, a ratchet wheel, spring means acting between the ratchet wheel and control body, a pin mounted on the control body for reciprocation between positions in which one end is engaged and disengaged with the ratchet teeth, means responsive to activation of a signal indicative of the failure of the controlled condition to force the one end of the pin against the ratchet teeth and thereby restrain the ratchet wheel from rotation in said other direction, means yieldably urging the ratchet wheel toward the end of the pin, and means disposed between the ratchet wheel and control body to frictionally engage the ratchet wheel for rotation with the control body in said one direction but permit rotation of the control body with respect thereto in the other direction.

10. In apparatus of the character defined in claim 9, wherein said control mechanism further includes a dog mounted on the body of the control mechanism in position to move into and out of engagement with the ratchet teeth, and means yieldably urging the dog into engagement with the ratchet teeth so that it will engage an abrupt surface thereof as the ratchet rotates with the control body and thus locate the ratchet wheel in a position in which the end of the pin engages an inclined surface of a tooth.

* * * * *